US011178990B2

(12) United States Patent
Guillot

(10) Patent No.: US 11,178,990 B2
(45) Date of Patent: Nov. 23, 2021

(54) PRESSURE ABSORBING ASSEMBLY FOR SUPPORTING A USER ABOVE A SUPPORT SURFACE

(71) Applicant: ACTIVE FUN COMPANY LIMITED, Hong Kong (CN)

(72) Inventor: Cyrille Guillot, Queenstown (NZ)

(73) Assignee: ACTIVE FUN COMPANY LIMITED

( * ) Notice: Subject to any disclaimer, the term of this patent is extended or adjusted under 35 U.S.C. 154(b) by 48 days.

(21) Appl. No.: 16/493,722

(22) PCT Filed: Mar. 9, 2018

(86) PCT No.: PCT/IB2018/051570

§ 371 (c)(1),
(2) Date: Sep. 12, 2019

(87) PCT Pub. No.: WO2018/167620

PCT Pub. Date: Sep. 20, 2018

(65) Prior Publication Data

US 2020/0029716 A1 Jan. 30, 2020

Related U.S. Application Data

(60) Provisional application No. 62/547,443, filed on Aug. 18, 2017, provisional application No. 62/471,835, filed on Mar. 15, 2017.

(51) Int. Cl.

| | |
|---|---|
| ***A47G 27/02*** | (2006.01) |
| ***A47C 1/00*** | (2006.01) |
| *A63B 5/11* | (2006.01) |

(52) U.S. Cl.

CPC ..... *A47G 27/0231* (2013.01); *A47C 1/00* (2013.01); *A63B 5/11* (2013.01)

(58) Field of Classification Search

CPC ..... A47G 27/0231; A47C 1/00; A47C 9/025; A47C 9/002; A63B 5/11; A63B 2208/0228

(Continued)

(56) References Cited

U.S. PATENT DOCUMENTS 2,324,970 A * 7/1943 Louisa ..... A63B 5/11 482/29
2,858,132 A * 10/1958 Sidlinger ..... A63B 5/11 482/28

(Continued)

FOREIGN PATENT DOCUMENTS

CN 2776460 Y 5/2006
CN 204996046 U 1/2016

(Continued)

OTHER PUBLICATIONS

International Search Report and Written Opinion of the International Search Authority for PCT/IB2018/051570, Active Fun Company Limited, dated Jun. 27, 2018 (related matter .24.PCT).

*Primary Examiner* — Babajide A Demuren
*Assistant Examiner* — Adam G Barlow
(74) *Attorney, Agent, or Firm* — Roeder & Broder LLP; Steven G. Roeder

(57) ABSTRACT

A pressure absorbing assembly (10) for supporting a user (35) relative to a support surface (16) includes a pressure absorber (12) and a resting component (14). The pressure absorber (12) is configured to contact the support surface (16). Additionally, the pressure absorber (12) is further configured to resiliently support the user (35) relative to the support surface (16). Further, the resting component (14) is coupled, e.g., directly coupled, to the Pressure absorber (12). Additionally, the resting component (14) is configured to be selectively engaged by the user (35) during use of the pressure absorber (12). The resting component (14) is configured to allow the user (35) to be in a seated, semi-seated, or somewhat reclined or leaning Position while still being situated on the pressure absorber (12). The pressure absorbing assembly (10) can also include a work station (2118) that is coupled to the pressure absorber (12).

20 Claims, 29 Drawing Sheets

(58) Field of Classification Search
USPC ..... 482/27–29
See application file for complete search history.

(56) References Cited

U.S. PATENT DOCUMENTS

| | | | | |
|---|---|---|---|---|
| 5,360,384 | A * | 11/1994 | Toensing | A63B 69/0064 482/23 |
| 6,478,718 | B2 * | 11/2002 | Rich | A63B 5/11 182/116 |
| 6,708,935 | B2 * | 3/2004 | Smeed | A61G 5/12 128/878 |
| 2009/0258759 | A1 * | 10/2009 | Chen | A63G 31/00 482/27 |
| 2010/0311545 | A1 * | 12/2010 | Fenn | A63B 5/11 482/29 |
| 2015/0080186 | A1 | 3/2015 | Carlin et al. | |
| 2018/0353789 | A1 * | 12/2018 | Tseng | A63B 1/00 |
| 2021/0093939 | A1 * | 4/2021 | Shirley-Smith | A63B 71/022 |

FOREIGN PATENT DOCUMENTS

| | | | |
|---|---|---|---|
| CN | 205252385 | U | 5/2016 |
| GB | 2529242 | A | 2/2016 |
| GB | 2535351 | B | 10/2016 |

* cited by examiner

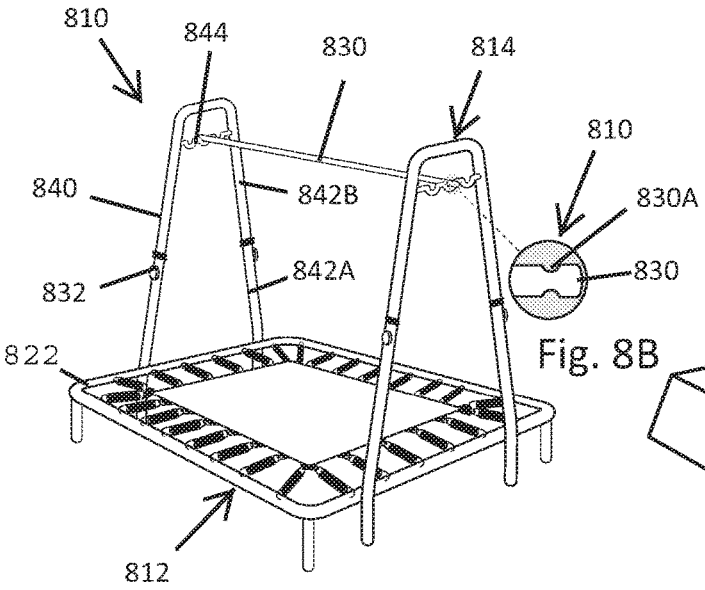
Fig. 8B
Fig. 8A
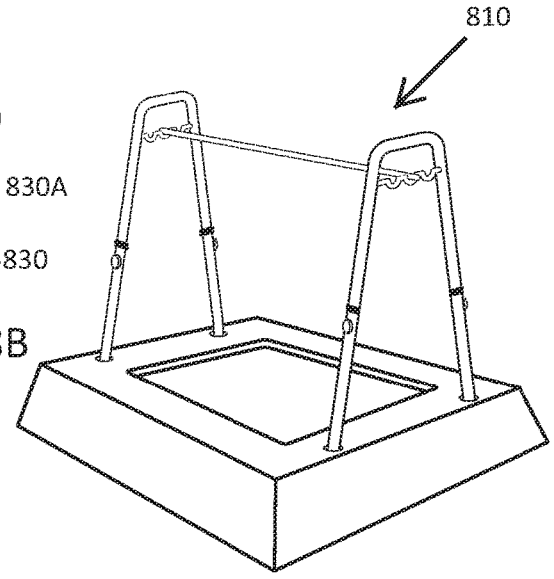
Fig. 8C

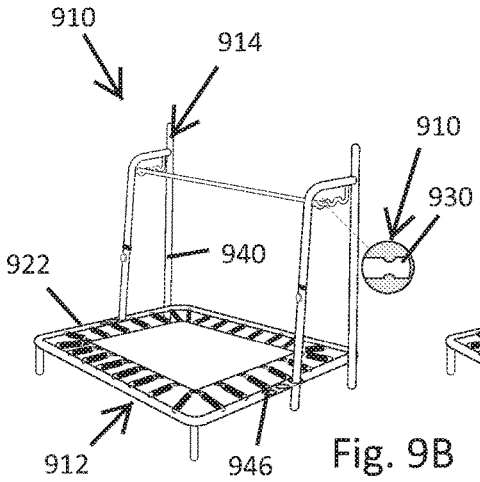
Fig. 9B
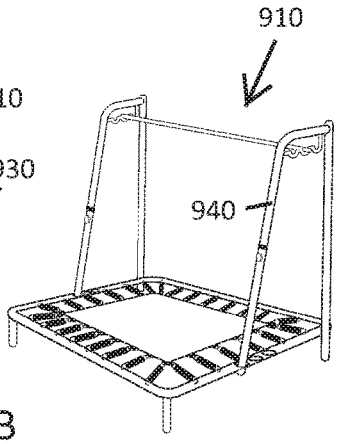
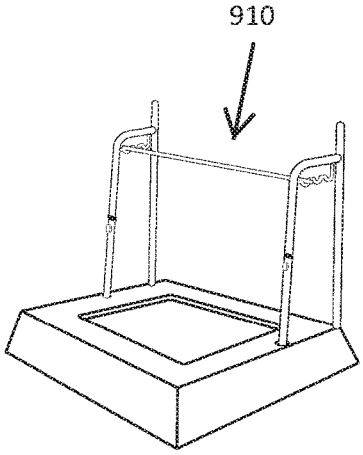
Fig. 9A
Fig. 9C
Fig. 9D

PRESSURE ABSORBING ASSEMBLY FOR SUPPORTING A USER ABOVE A SUPPORT SURFACE

RELATED APPLICATIONS

This application claims priority on U.S. Provisional Application Ser. No. 62/471,835, filed on Mar. 15, 2017, and entitled "REBOUND ASSEMBLY COUPLED TO STAND-UP DESK ASSEMBLY", and U.S. Provisional Application Ser. No. 62/547,443, filed on Aug. 18, 2017, and entitled "PRESSURE ABSORBING ASSEMBLY FOR SUPPORTING A USER ABOVE A SUPPORT SURFACE". To the extent permissible, the contents of U.S. Provisional Application Ser. Nos. 62/471,835 and 62/547,443 are incorporated in their entirety herein by reference.

BACKGROUND

In recent years, many studies have been released that focus on the ill-effects of excessive sitting. As a result, many people now have an increased desire to perform various activities in a standing position that have traditionally been performed in a seated position. For example, in recent years, the popularity of stand-up desks has greatly increased. Standing allows the individual to be more active, e.g., shifting weight from one leg to the other and pacing as desired, thereby releasing restless energy and improving focus and concentration. Thus, stand-up desks have become much more popular to use as working desks and lecterns.

Unfortunately, standing for long periods of time, whether it be at a stand-up desk or otherwise, can cause great amounts of fatigue for an individual. Thus, it is desired to provide a support device that can support the individual for relatively long periods of time while reducing the amount of fatigue for the individual. Existing support devices typically come in the form of mats that can be made from foam or other similar materials. While such mats can make standing less difficult over a period of time, they do not offer sufficient release and rest on a long-term basis. This lack of proper resting features prevents most users from enjoying their stand-up desks, or other work stations that are typically utilized in a standing position, in a more permanent way. At present, most users of stand-up desks only use these desks as an alternative work station, as working in a standing position is difficult on a long-term or permanent basis. Somewhat similarly, many users of other types of work stations that are typically utilized with the user in a standing position, have limitations on the overall time that they can be effectively using or working at such work stations.

SUMMARY

The present invention is directed toward a pressure absorbing assembly for supporting a user relative to a support surface. In various embodiments, the pressure absorbing assembly includes a pressure absorber and a resting component. The pressure absorber is configured to contact the support surface. Additionally, the pressure absorber is further configured to resiliently support the user relative to the support surface. Further, the resting component is coupled, e.g., directly coupled, to the pressure absorber. Additionally, the resting component is configured to be selectively engaged by the user during use of the pressure absorber. In such embodiments, the resting component is configured to allow the user to be in a seated, semi-seated, or somewhat reclined or leaning position while still being situated on the pressure absorber.

As provided herein, the pressure absorber is configured to function as a stress, weight and pressure release device for the user, and is not intended to provide a jumping or bouncing surface in a manner similar to a rebound device or trampoline. Additionally, the various designs for the resting component illustrated and described herein are configured to produce support that will provide resting options for the user of the pressure absorbing assembly, without being in the way of the user when working in a standing position.

In some embodiments, the pressure absorber includes a pressure absorbing mat, an absorber frame, and a plurality of resilient members that resiliently couple the pressure absorbing mat to the absorber frame to maintain the pressure absorbing mat in tension. Additionally, the pressure absorber can further include a plurality of legs that are coupled to the absorber frame, the plurality of legs being configured to support the absorber frame and the pressure absorbing mat above and away from the support surface. In certain such embodiments, the plurality of legs are configured or sized to maintain the absorber frame, and thus the pressure absorbing mat when in an undeflected/unused configuration, less than approximately thirty centimeters above the support surface. Stated in another manner, in such embodiments, the absorber frame has a frame height that is less than approximately thirty centimeters above the support surface. With such design, it is much easier for the user to move onto and off of the pressure absorbing mat. Moreover, in certain such embodiments, the frame height of the absorber frame is between approximately ten centimeters and fifteen centimeters above the support surface.

Further, in certain embodiments, the resting component is fixedly coupled to the pressure absorber. Alternatively, in other embodiments, the resting component can be removably coupled to the pressure absorber. As provided in detail herein, it is appreciated that the resting component can be provided in many different formats and/or designs.

Additionally, in some embodiments, the pressure absorbing assembly can further include a work station that is coupled to the pressure absorber. In certain such embodiments, the work station is directly coupled to the pressure absorber. The work station can be configured to provide a working surface for the user of the pressure absorbing assembly. Further, in one non-exclusive such embodiment, the work station can be a stand-up desk assembly that is coupled, e.g., directly coupled, to the pressure absorber, e.g., to the pressure absorbing mat and/or the resting component. Alternatively, in other embodiments, the work station can be another suitable type of work station that is typically used with the user primarily in a standing position.

In certain embodiments, the stand-up desk assembly includes a desktop and a desk support assembly that supports the desktop above the support surface. In some such embodiments, the desk support assembly that adjustably supports the desktop above the support surface.

Additionally, the present invention is further directed toward a pressure absorbing assembly for supporting a user relative to a support surface, the pressure absorbing assembly including a pressure absorber that is configured to contact the support surface, the pressure absorber being configured to resiliently support the user relative to the support surface; and a work station that is coupled to the pressure absorber, the work station being configured to provide a working area for the user of the pressure absorbing assembly.

Further, the present invention is also directed toward a pressure absorbing assembly for supporting a user relative to a support surface, the pressure absorbing assembly including (A) a pressure absorber that is configured to contact the support surface, the pressure absorber being configured to resiliently support the user relative to the support surface, the pressure absorber including a pressure absorbing mat, an absorber frame, a plurality of resilient members that resiliently couple the pressure absorbing mat to the absorber frame to maintain the pressure absorbing mat in tension, and a plurality of legs that are coupled to the absorber frame and support the absorber frame and the pressure absorbing mat above and away from the support surface, wherein the absorber frame has a frame height that is less than approximately thirty centimeters above the support surface; (B) a resting component that is coupled to the pressure absorber, the resting component being configured to be selectively engaged by the user during use of the pressure absorber; and (C) a work station that is coupled to the pressure absorber, the work station being configured to provide a working area for the user of the pressure absorbing assembly.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 8A is a simplified perspective view illustration of a portion of another embodiment of the pressure absorbing assembly;

FIG. 8B is an enlarged view illustration of a portion of the pressure absorbing assembly illustrated in FIG. 8A;

FIG. 8C is a simplified perspective view illustration of the pressure absorbing assembly illustrated in FIG. 8A;

FIG. 9A is a simplified perspective view illustration of a portion of yet another embodiment of the pressure absorbing assembly, the pressure absorbing assembly including a resting component that is in a first position;

FIG. 9B is an enlarged view illustration of a portion of the pressure absorbing assembly illustrated in FIG. 9A;

FIG. 9C is a simplified perspective view illustration of the portion of the pressure absorbing assembly illustrated in FIG. 9A, the resting component being in a second position;

FIG. 9D is a simplified perspective view illustration of the pressure absorbing assembly illustrated in FIG. 9A;

DESCRIPTION

Figure 1A:
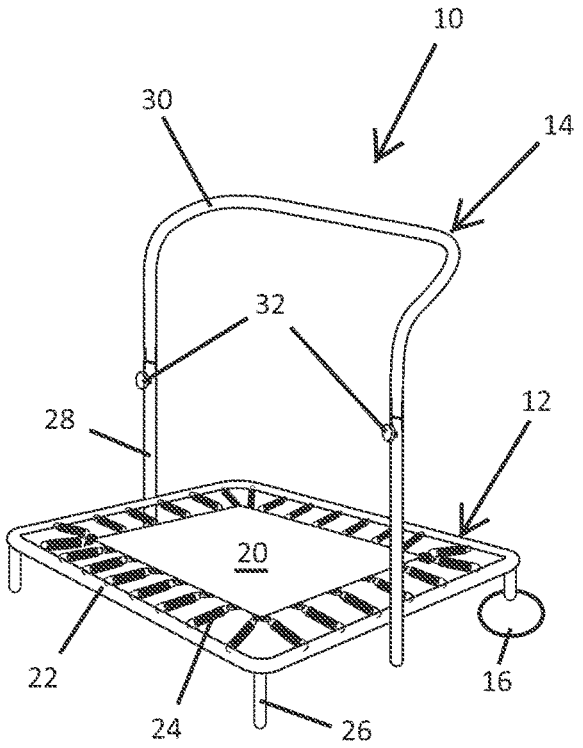
FIG. 1A is a simplified perspective view illustration of a portion of an embodiment of a pressure absorbing assembly having features of the present invention.

Embodiments of the present invention are described herein in the context of a pressure absorbing assembly that is usable for supporting a user above a support surface. In particular, in various embodiments, the pressure absorbing assembly includes a pressure absorber that enables the user to be resiliently supported in a generally standing position with reduced fatigue, while also providing a resting component that further enables the user to perform desired activities in a generally standing position for longer periods of time. Additionally, as illustrated herein, the resting component of the pressure absorbing assembly is configured to provide the user with various resting options without being in the way of the user working in a standing position.

Further, in certain embodiments, the pressure absorbing assembly can also include a work station that is coupled, e.g., directly coupled, to the pressure absorber and/or the resting component. For example, in one non-exclusive alternative embodiment, the work station can be a desk assembly such as a stand-up desk assembly that is coupled, e.g., directly coupled, to the pressure absorber and/or the resting component. In such embodiment, the present invention combines the beneficial aspects of a pressure absorbing assembly with the beneficial aspects of a stand-up desk assembly into a single integrated unit. Alternatively, in other such embodiments, the work station can include a bar, a guardhouse, a kitchen work station (e.g., counter, stove top, oven, etc.), a factory assembly line, or another suitable work station, that is coupled to the pressure absorber and/or the resting component. It is appreciated, however, that the pressure absorbing assembly can also be used with any such working stations, without the pressure absorber or the resting component being actually physically or mechanically coupled to the work station.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

FIG. 1A is a simplified perspective view illustration of a portion of an embodiment of a pressure absorbing assembly 10 having features of the present invention. The design of the pressure absorbing assembly 10 can be varied. In certain embodiments, as shown in FIG. 1A, the pressure absorbing assembly 10 includes a pressure absorber 12, i.e. an active mat, and a resting component 14 that are coupled to one another. In some such embodiments, the pressure absorber 12 and the resting component 14 are directly coupled to one another.

As an overview, the pressure absorbing assembly 10 is uniquely configured to resiliently support a user, e.g., a person 35 (illustrated, for example, in FIG. 1C), above a support surface 16, such as a floor or the ground, while decreasing the stress of the weight of the user 35 being in a standing position, and while further allowing the user 35 to periodically more fully relieve the stress from standing for long periods of time. More particularly, the pressure absorber 12, or active mat, is configured to provide a resilient surface for supporting the user 35 to reduce much of the stress, weight and pressure for the user 35 from standing for long periods of time at a stand-up desk, another suitable working surface, or other suitable location; while the resting component 14 is configured to provide the user 35 with a place to lean or be in a seated or semi-seated position periodically during the use of the pressure absorber 12. Moreover, in various embodiments, the pressure absorbing assembly 10 provides such features within a single integrated unit. With this design, the user 35 can realize certain health benefits while avoiding the problems that come along with sitting for extended periods of time. Further, such advantages can be realized while still accomplishing any necessary tasks that are more traditionally performed in a seated position.

Additionally, as provided herein below, in certain embodiments, the pressure absorbing assembly 10 can further include a work station 2118, e.g., a desk assembly (illustrated, for example, in FIG. 21), that is coupled to one or both of the pressure absorber 12 and the resting component 14, and that provides the user 35 with a working surface in order to effectively perform tasks that require such a surface. In certain embodiments, the pressure absorber 12 can be fixedly secured to the work station 2118, e.g., the desk assembly or other work station. Alternatively, for example, the pressure absorbing assembly 10 can be separate and spaced apart from the desk assembly 2118 or other work station. Still alternatively, in other such embodiments, the work station 2118 can include a bar 2818 (see e.g., FIG. 28), a guardhouse 2918 (see e.g., FIG. 29), a kitchen work station 3018 (e.g., counter, stove top, oven, etc., see e.g., FIG. 30)), a factory assembly line 3118 (see e.g., FIG. 31), or another suitable work station, that is coupled to or otherwise positioned adjacent to the pressure absorber 12 and/or the resting component 14.

In certain, non-exclusive embodiments, the pressure absorber 12 is substantially parallel to and spaced apart from the support surface 16. Further, the pressure absorber 2 can be substantially parallel to and spaced apart from desk top.

The design of the pressure absorber 12 can be varied to suit the specific requirements of the pressure absorbing assembly 10. In various embodiments, as shown in the embodiment illustrated in FIG. 1A, the pressure absorber 12 includes a pressure absorbing mat 20 (also referred to herein simply as an "absorbing mat"), an absorber frame 22, a plurality of resilient members 24, and a plurality of legs 26. The plurality of resilient members 24 connect the absorbing mat 20 to the absorber frame 22, so as to place the absorbing mat 20 in tension.

The absorbing mat 20 provides a resilient surface for the user 35 to stand on in order to reduce the stress and pressure from standing for long periods of time. Additionally, as provided herein, in various embodiments, the absorbing mat 20 is configured to be fairly close to the support surface 16 such that the user 35 has an easy time getting on and off of the absorbing mat 20. For example, in certain embodiments, the absorbing mat 20 can be configured to be positioned less than approximately thirty centimeters above the support surface 16, i.e. in a relaxed, undeflected, or not in use configuration. More particularly, in some such embodiments, the absorbing mat 20 can be configured to be positioned between approximately ten centimeters and fifteen centimeters above the support surface 16. Alternatively, in other embodiments, the absorbing mat 20 can be configured to be positioned more than thirty centimeters above the support surface 16.

It is appreciated that with the absorbing mat 20 being positioned so close to the support surface 16, the pressure absorber 12 is typically configured such that there is limited deflection of the absorbing mat 20 when being used by any suitable user 35, e.g., only allowing slight sinking of the absorbing mat 20 due to the weight of the user 35. More particularly, the pressure absorber 20 is not configured for the user 35 to actually jump or bounce on the absorbing mat 20, but rather just to stand or recline somewhat (i.e. with use of the resting component 22) during use of the pressure absorbing assembly 10.

The size and shape of the absorbing mat 20 can be varied depending upon the requirements of the pressure absorbing assembly 10, the pressure absorber 12 and/or the absorber frame 22. In the embodiment illustrated in FIG. 1A, the absorbing mat 20 is substantially rectangle-shaped. Additionally, although FIG. 1A illustrates that the absorbing mat 20 is fairly small in overall length and width dimensions, it is appreciated that the absorbing mat 20 can have any suitable length and width dimensions depending on the intended use of the pressure absorbing assembly 10. More particularly, in certain embodiments, the absorbing mat 20 has a mat length of between approximately fifty-five centimeters and ninety-five centimeters, and a mat width of between approximately forty centimeters and seventy-five centimeters. Alternatively, the absorbing mat 20 can have dimensions that are greater than or less than the dimensions specifically noted above. Still alternatively, the absorbing mat 20 can be substantially circle-shaped, oval-shaped, square-shaped, or some other shape, and can have any suitable dimensions.

Further, the absorbing mat 20 can be formed from various sturdy fabric and/or synthetic materials that are designed to effectively absorb the pressure from a person 35 standing on the pressure absorber 12 for extended periods of time. For example, the absorbing mat 20 can be formed from a mesh material or other similar material. Alternatively, the absorbing mat 20 can be formed from materials including heavy canvas, vinyl, nylon, or other suitable materials.

Additionally, the size and shape of the absorber frame 22 can be varied depending on the requirements of the pressure absorber 12, the absorbing mat 20 and/or the plurality of resilient members 24. In the embodiment illustrated in FIG. 1A, the absorber frame 22 is substantially rectangle-shaped. Further, although FIG. 1A illustrates that the absorber frame 22 is fairly small in overall length and width dimensions, it is appreciated that the absorber frame 22 can have any suitable length and width dimensions depending on the intended use of the pressure absorbing assembly 10. More particularly, in some embodiments, the absorber frame 22 has a frame length of between approximately seventy centimeters and one hundred ten centimeters, and a frame width of between approximately fifty-five centimeters and ninety centimeters. Alternatively, the absorber frame 22 can have dimensions that are greater than or less than the dimensions specifically noted above. Still alternatively, the absorber frame 22 can be substantially circle-shaped, oval-shaped, square-shaped, or some other shape, and can have any suitable dimensions.

Further, as with the absorbing mat 20, in various embodiments, the absorber frame 22 is configured to be fairly close to the support surface 16 such that the user 35 has an easy time getting on and off of the absorbing mat 20. For example, in certain embodiments, the absorber frame 22 can be configured to be positioned less than approximately thirty centimeters above the support surface 16. More particularly, in some such embodiments, the absorber frame 22 can be configured to be positioned between approximately ten centimeters and fifteen centimeters above the support surface 16. Alternatively, in other embodiments, the absorber frame 22 can be configured to be positioned more than thirty centimeters above the support surface 16.

In certain embodiments, the absorber frame 22 can include a plurality of sections that can be secured together to form the absorber frame 22. With this modular-type design, shipping and disassembly for storage of the absorber frame 22 is facilitated. Alternatively, the absorber frame 22 can be formed as a unitary structure. Further, the absorber frame 22 can be formed from various materials such as metal, wood, plastic, composite materials, ceramic, or any other suitably rigid materials. Alternatively, a combination of any of such materials can be used.

As noted above, the plurality of resilient members 24 connect the absorbing mat 20 to the absorber frame 22, so as to maintain the absorbing mat 20 in tension. The resilient members 24 can be connected to the absorbing mat 20 and the absorber frame 22 in any suitable manner. Each resilient member 24 can include a spring, elastic, plastic, rubber, or other suitably resilient structure. The size and number of the resilient members 24 can vary. For example, in one embodiment, the pressure absorbing assembly can include approximately twenty-eight similarly-sized extension springs that are substantially equally spaced around the perimeter of the absorbing mat 20. Each spring can have a one-inch diameter and be formed from 12-gauge steel. Alternatively, the pressure absorber 12 can be designed to have greater than twenty-eight or fewer than twenty-eight resilient members 24 that have various dimensions and are made of various materials. Alternatively, for example, instead of springs, one or more of the resilient members 24 can be a bungee cord. For example, FIG. 1E is a non-exclusive alternative embodiment of the pressure absorbing assembly 10E where the plurality of resilient members 24E includes bungee cords in lieu of the springs illustrated in FIG. 1A.

It is appreciated that the addition or subtraction of resilient members 24 can be used to adjust the tension and effect of the absorbing mat 20 on the user 35, according to his/her weight and the absorbent effect required, and the most suitable impact on body joints and articulations. Additionally, as noted above, the pressure absorber 12 is typically configured to allow only limited deflection of the absorbing mat 20 when being used by a user 35. As such, in some embodiments, the plurality of resilient members 24 are configured to have a high enough overall tension for the absorbing mat 20 so that the absorbing mat 20 only deflects between approximately eight centimeters and thirteen centimeters when being used by the user 35. It is appreciated, however, that the true deflection of the absorbing mat 20 will also be dependent upon the weight of the user 35.

In the embodiment illustrated in FIG. 1A, the legs 26 are connected to the absorber frame 22 and are spaced apart around the absorber frame 22, so as to support the absorber frame 22 and the absorbing mat 20 above and away from the support surface 16. The configuration and the number of legs 26 can vary. For example, in one embodiment, the pressure absorber 12 has four substantially straight legs 26, with one leg 26 being connected to the absorber frame 22 at or near each corner of the absorber frame 22. Alternatively, the pressure absorber 12 can be designed to have more than four legs 26 or less than four legs 26, the legs 26 can have other than a straight leg design, and/or the legs can be positioned in a different manner about the absorber frame 22.

Additionally, as shown, the legs 26 are short enough such that the absorbing mat 20 and the absorber frame 22 are positioned fairly close to the support surface 16, such as discussed herein above. For example, in some embodiments, the legs 26 can be less than approximately thirty centimeters long as they extend between the absorber frame 22 and the support surface 16. More particularly, in certain such embodiments, the legs 26 can be between ten centimeters and fifteen centimeters long as they extend between the absorber frame 22 and the support surface 16.

In certain embodiments, the pressure absorber 12 can be configured to carry up to two persons at any given time. For example, in some such embodiments, the pressure absorber 12 can be configured to effectively support up to four hundred pounds at any given time without exceeding the desired deflection limits for the absorbing mat 20. Alternatively, the pressure absorber 12 can be configured to effectively support greater than or less than four hundred pounds at any given time.

Further, the pressure absorber 12 and/or the legs 26 of the pressure absorber 12 can be configured to provide any desired ground clearance between the absorbing mat 20 and the support surface 16. For example, in certain embodiments, the pressure absorber 12 and/or the legs 26 can be configured to provide ground clearance, i.e. spacing between the absorbing mat 20 and the support surface 16, of between approximately five centimeters and twenty centimeters. Alternatively, the pressure absorber 12 and/or the legs 26 can be configured to provide ground clearance of greater than twenty centimeters or less than five centimeters. As provided herein, the desired ground clearance can be provided at least in part to allow for easy and secure adjustment of the resting component 14 that is coupled to the pressure absorber 12.

In various embodiments, the resting component 14 is configured to help provide support and stability for the user 35 of the pressure absorbing assembly 10. More particularly, the resting component 14 is designed to help support and reduce fatigue of the user 35 and to help the user 35 to maintain balance while he or she is positioned on the pressure absorber 12. The design of the resting component 14 can be varied to suit the requirements of the pressure absorbing assembly 10 and/or the preferences of the user 35 who is using the pressure absorbing assembly 10. For example, in certain embodiments, as illustrated in FIG. 1A, the resting component 14 can include a pair of vertical support components 28 and a central support component 30. Alternatively, as illustrated herein below in various non-exclusive alternative embodiments, the resting component 14 can have a different design than what is shown in FIG. 1A.

As shown, the two vertical support components 28 are fixedly coupled to opposite sides of the absorber frame 22. In this embodiment, the vertical support components 28 each extend down below the absorber frame 22 and can contact the support surface 16 to provide greater stability for the resting component 14. Additionally, the vertical support components 28 extend in a generally upward direction above and away from the absorber frame 22.

Additionally, the central support component 30 is coupled to, e.g., adjustably coupled to, each of the vertical support components 28. More particularly, as shown, the central support component 30 can extend briefly upwardly from the vertical support components 28 and then extend rearwardly at an angle before extending substantially horizontally across so that the central support component 30 effectively extends from one side of the pressure absorber 12 to the other. The substantially horizontal portion of the central support component 30 provides a place for the user 35 to lean against and/or position themselves in a semi-seated position during use of the pressure absorbing assembly 10. Stated in another manner, the central support component 30 is configured to be selectively engaged by the user 35 during use of the pressure absorbing assembly 10. This design enables the user 35 to transfer a lot of his or her weight onto the central support component 30 at any desired times during use of the pressure absorbing assembly 10. It is appreciated that with this design of the resting component 14, it can be desired that the user 35 still have his or her feet resting on the absorbing mat 20 of the pressure absorber 12 to better help maintain his or her balance while using the pressure absorbing assembly 10.

The vertical support components 28 and the central support component 30 can be formed from any suitable materials. For example, in some embodiments, the vertical support components 28 and the central support component 30 are formed from a tubular metallic material. Alternatively, the vertical support components 28 and the central support components 30 can be formed from metal, wood, plastic, composite materials, ceramic, or any other suitably rigid materials, or any combination thereof.

Additionally, as noted, the central support component 30 can be adjustably coupled to the vertical support components 28. More particularly, as shown, the resting component 14 can include one or more adjusters 32 that adjustably couple the central support component 30 to each of the vertical support components 28. The adjusters 32 enable the height of the central support component 30 to be selectively adjusted to suit the design requirements of the user 35 of the pressure absorbing assembly 10. In one embodiment, the central support component 30 can be telescopingly coupled to each of the vertical support components 28. Alternatively, the central support component 30 can be adjustably coupled to the vertical support components 28 in a different manner. Still alternatively, the central support component 30 can be adjustable in depth to allow the user 35 to sit or lean back further from or closer to the center of the absorbing mat 20. Yet alternatively, the central support component 30 can be rigidly coupled to each of the vertical support components 28 such that the central support component 30 is not adjustable in height and/or depth.

Further, in certain alternative embodiments, the resting component 14 can be fixedly coupled to the pressure absorber 12, or the resting component 14 can be partially or completely removable from the pressure absorber 12.

Figure 1B:
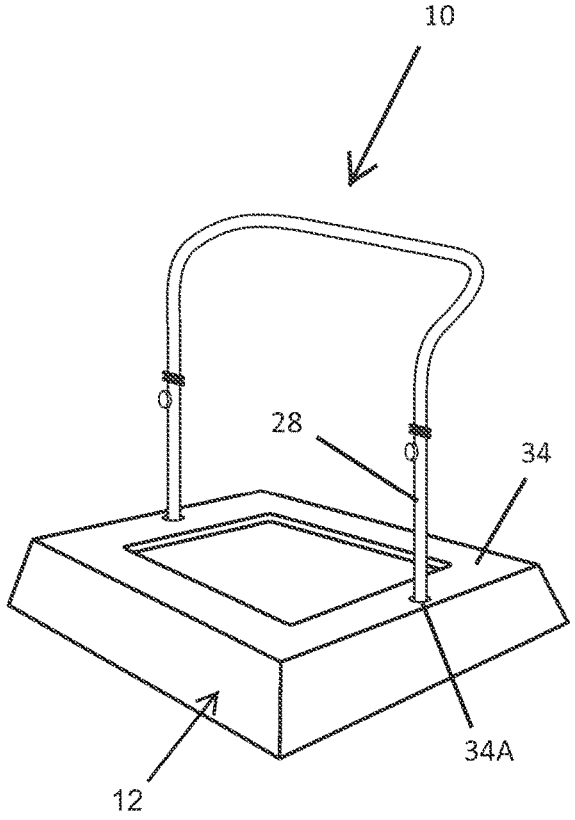
FIG. 1B is a simplified perspective view illustration of the pressure absorbing assembly illustrated in FIG. 1A.

FIG. 1B is a simplified perspective view illustration of the pressure absorbing assembly 10 illustrated in FIG. 1A. More particularly, FIG. 1B illustrates that the pressure absorbing assembly 10, i.e. the pressure absorber 12, can further include a cover 34. As illustrated, in certain embodiments, the cover 34 substantially covers at least a portion of the plurality of resilient members 24 (illustrated in FIG. 1A), as well as covering the absorber frame 22 (illustrated in FIG. 1A) and the legs 26 (illustrated in FIG. 1A). The cover 34 is designed to help protect the user 35 (illustrated in FIG. 1C) from injury by preventing the user 35 from getting hands or feet or other body parts caught or pinched within the plurality of resilient members 24. Additionally, the cover 34 can be configured to provide a more aesthetically pleasing appearance for the pressure absorbing assembly 10.

In some embodiments, the cover 34 can be made of nylon or other suitable, pliable material. Alternatively, in other embodiments, the cover 34 can be made of a hard material, such as bent and welded material, injected plastic, or cut and/or molded wood panels. In such alternative embodiments, the cover 34 may or may not be also covered for aesthetic and/or comfort purposes by (padded) fabric.

Additionally, in certain embodiments, a layer of padding (not illustrated) can be positioned between the cover 34 and the plurality of resilient members 24.

As further illustrated in FIG. 1B, the cover 34 can include a pair of cover apertures 34A that are configured to receive the vertical support components 28 adjacent to the absorber frame 22.

Figure 1C:
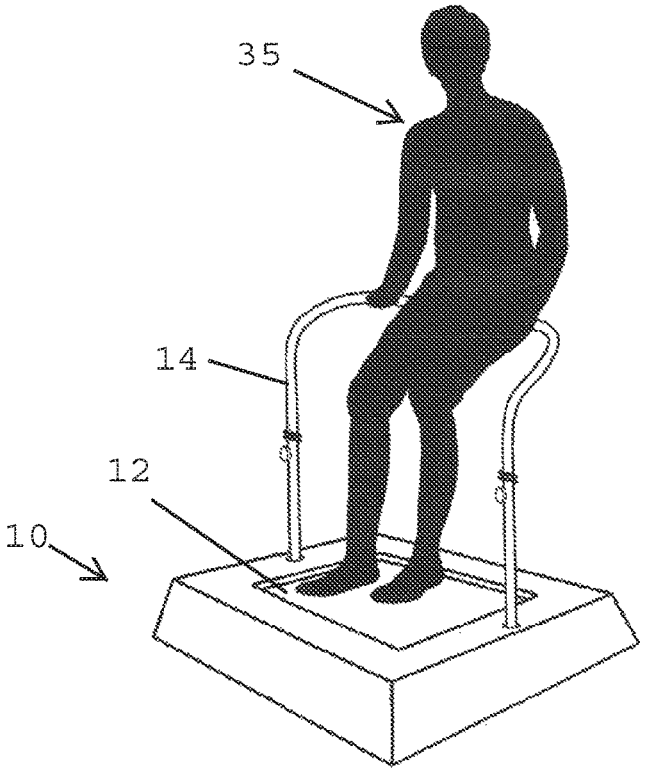
FIG. 1C is a simplified perspective view illustration of the pressure absorbing assembly illustrated in FIG. 1B with a person thereon.
Figure 1D:
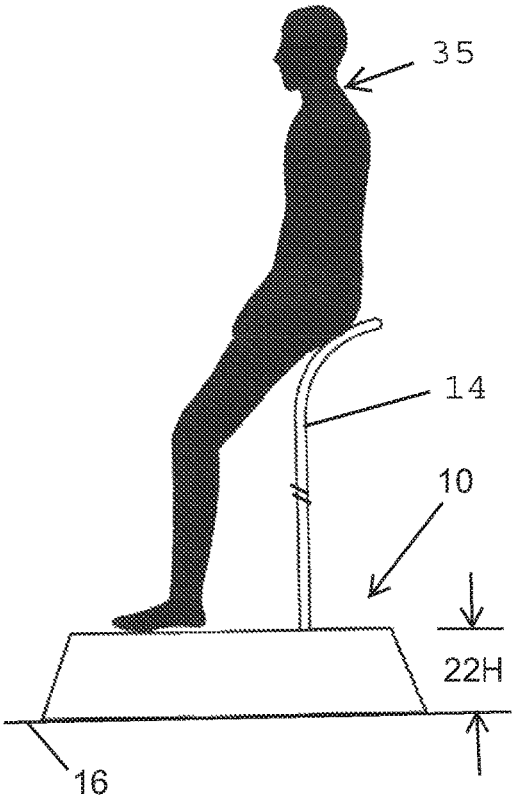
FIG. 1D is a simplified side view illustration of the pressure absorbing assembly illustrated in FIG. 1B with the person thereon.
Figure 1E:
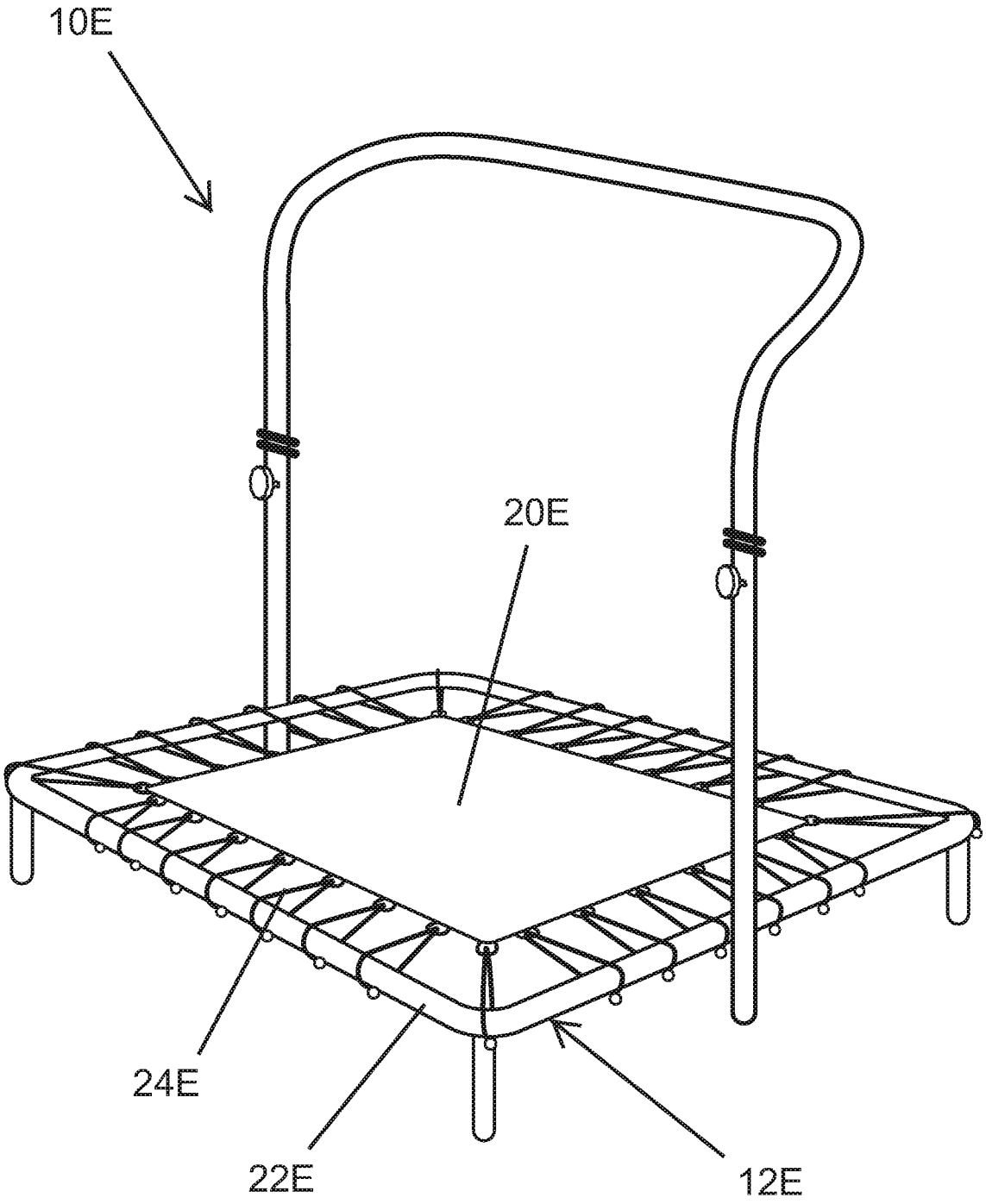
FIG. 1E is a simplified perspective view illustration of a slightly modified embodiment of the pressure absorbing assembly illustrated in FIG. 1A.

FIG. 1C is a simplified perspective view illustration and FIG. 1D is a side view illustration of the pressure absorbing assembly 10 of FIG. 1B with a person 35 positioned thereon. More specifically, in FIGS. 10 and 1D, the person 35 is standing/resting their feet on the pressure absorber 12, while sitting or leaning on the resting component 14. In this embodiment, and the other embodiments provided herein, the resting component 14 can be strong enough and durable enough to support the entire weight of the person 35. Further, as shown, the resting component 14 is at an appropriate height and position (or can be adjusted to a correct height/position for the particular user 35) relative to the pressure absorber 12 to support the person 35 while leaning or sitting.

Additionally, FIG. 1D further illustrates a frame height 22H of the absorber frame 22 (illustrated in FIG. 1A), i.e. the distance of the absorber frame 22 above the support surface 16. For example, as noted herein above, in certain embodiments, the absorber frame 22 can have a frame height 22H that is less than approximately thirty centimeters above the support surface 16. More specifically, in some such embodiments, the absorber frame 22 can have a frame height 22H of between approximately ten centimeters and fifteen centimeters above the support surface 16. Alternatively, the absorber frame 22 can have another suitable frame height 22H, e.g., greater than thirty centimeters or some other value less than thirty centimeters.

FIG. 1E is a simplified perspective view illustration of a slightly modified embodiment of the pressure absorbing assembly 10E. In particular, as noted above, in the embodiment shown in FIG. 1E, the pressure absorber 12E includes the plurality of resilient members 24E for connecting the absorbing mat 20E to the absorber frame 22E being provided in a different form. More specifically, the plurality of resilient members 24E are provided in the form of bungee cords that resiliently connect the absorbing mat 20E to the absorber frame 22E so as to maintain the absorbing mat 20E in tension.

Figure 2A:
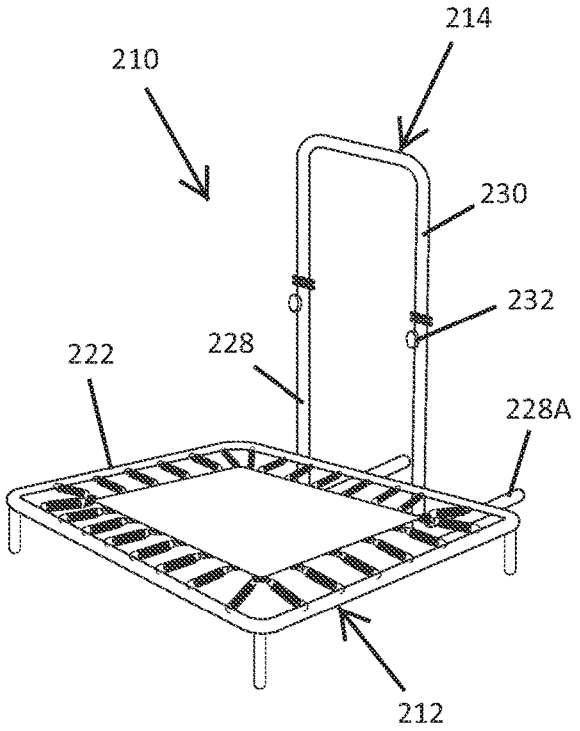
FIG. 2A is a simplified perspective view illustration of a portion of another embodiment of the pressure absorbing assembly.

FIG. 2A is a simplified perspective view illustration of a portion of another embodiment of the pressure absorbing assembly 210. As shown, this embodiment of the pressure absorbing assembly 210 is somewhat similar to the previous embodiments. For example, the pressure absorbing assembly 210 again includes a pressure absorber 212 that is substantially similar to the previous embodiments. Accordingly, the pressure absorber 212 will not again be described in detail.

However, in this embodiment, the design of the resting component 214 is somewhat different than in the previous embodiments. As shown in FIG. 2A, the resting component 214 includes a pair of vertical support components 228 that are coupled to one side of the absorber frame 222 and extend generally upward from the absorber frame 222. The vertical support components 228 further include feet 228A that extend horizontally at the base of the vertical support components 228 and are configured to contact the support surface 16 (illustrated in FIG. 1A) and/or wall to provide stability for the resting component 214. As illustrated, the resting component 214 further includes a central support component 230 that is adjustably coupled, e.g., with one or more adjusters 232, to the vertical support components 228. In this embodiment, the central support component 230 is substantially inverted U-shaped, and extends substantially directly upward from the vertical support components 228. Additionally, as in the previous embodiment, the central support component 230 is configured to be selectively engaged by the user 35 (illustrated in FIG. 1C) during use of the pressure absorbing assembly 210.

Figure 2B:
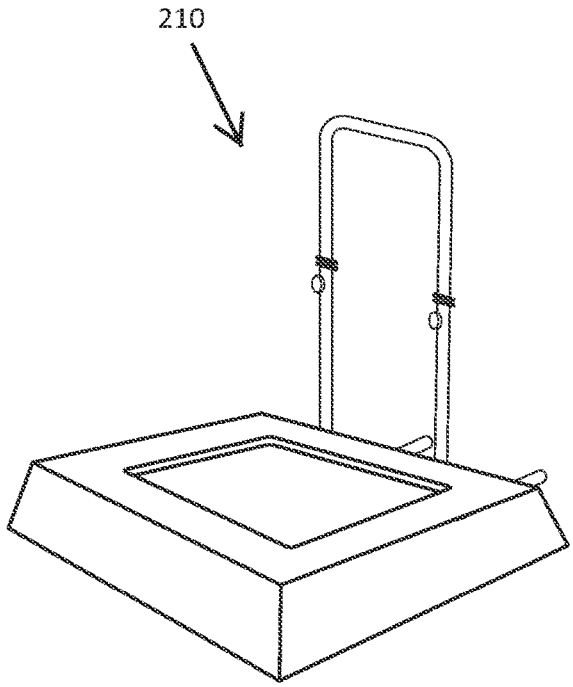
FIG. 2B is a simplified perspective view illustration of the pressure absorbing assembly illustrated in FIG. 2A.

FIG. 2B is a simplified perspective view illustration of the pressure absorbing assembly 210 illustrated in FIG. 2A.

Figure 3A:
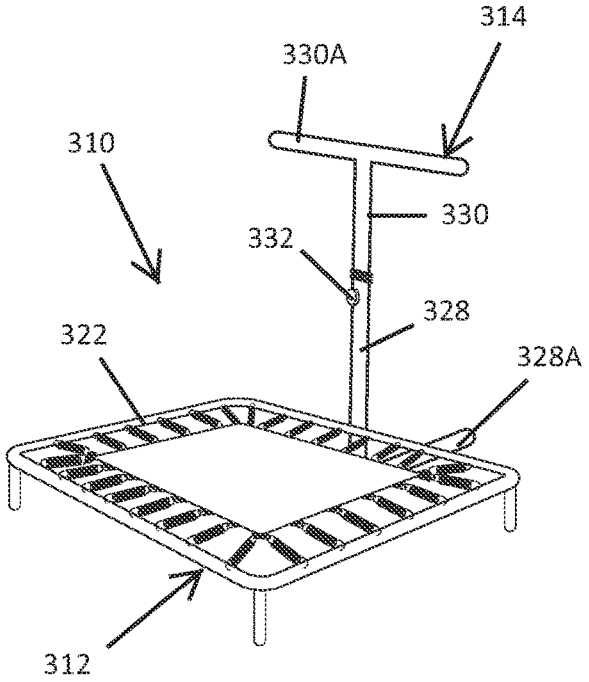
FIG. 3A is a simplified perspective view illustration of a portion of still another embodiment of the pressure absorbing assembly.

FIG. 3A is a simplified perspective view illustration of a portion of still another embodiment of the pressure absorbing assembly 310. As shown, this embodiment of the pressure absorbing assembly 310 is somewhat similar to the previous embodiments. For example, the pressure absorbing assembly 310 again includes a pressure absorber 312 that is substantially similar to the previous embodiments. Accordingly, the pressure absorber 312 will not again be described in detail.

However, in this embodiment, the design of the resting component 314 is somewhat different than in the previous embodiments. As shown in FIG. 3A, the resting component 314 includes a single vertical support component 328 that is coupled to the absorber frame 322 and extends generally upward from the absorber frame 322. The vertical support component 328 further includes a foot 328A that extends horizontally at the base of the vertical support component 328 and is configured to contact the support surface 16 (illustrated in FIG. 1A) to provide stability for the resting component 314. As illustrated, the resting component 314 further includes a central support component 330 that is adjustably coupled, e.g., with an adjuster 332, to the vertical support component 328. In this embodiment, the central support component 330 is substantially T-shaped, and extends substantially directly upward from the vertical support component 328. In this embodiment, the arms 330A of the T-shaped central support component 330 provide the surface for the user 35 (illustrated in FIG. 1C) to lean against and/or be positioned in a semi-seated position on during use of the pressure absorbing assembly 310. Stated in another manner, the central support component 330 is again configured to be selectively engaged by the user 35 during use of the pressure absorbing assembly 310.

Figure 3B:
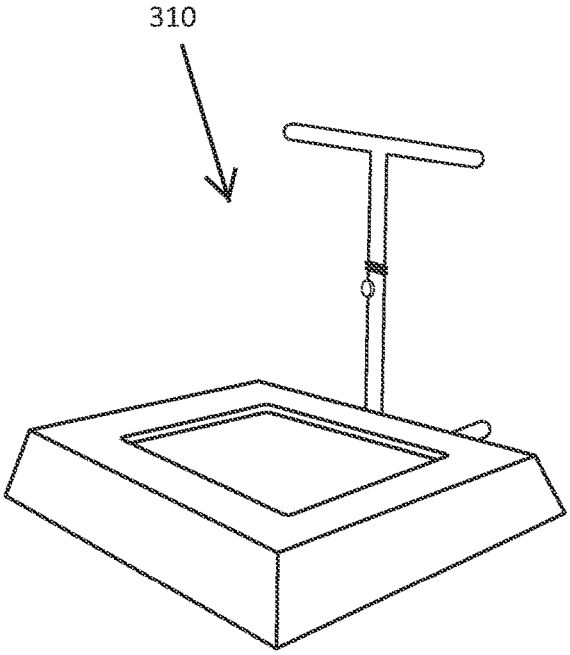
FIG. 3B is a simplified perspective view illustration of the pressure absorbing assembly illustrated in FIG. 3A.

FIG. 3B is a simplified perspective view illustration of the pressure absorbing assembly 310 illustrated in FIG. 3A.

Figure 4A:
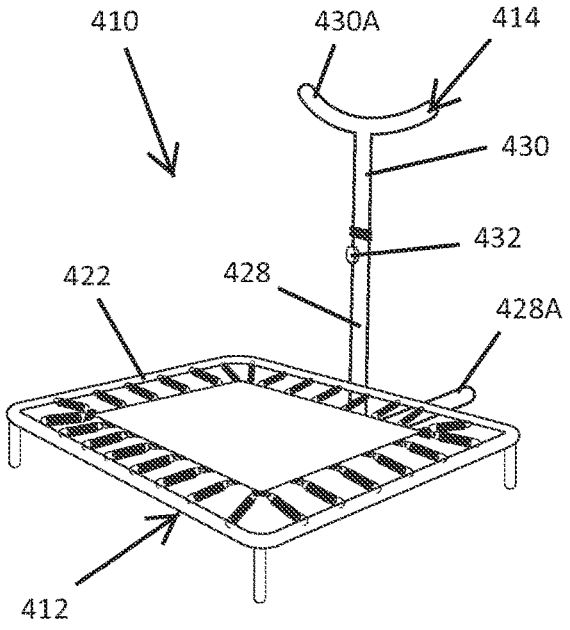
FIG. 4A is a simplified perspective view illustration of a portion of another embodiment of the pressure absorbing assembly.

FIG. 4A is a simplified perspective view illustration of a portion of another embodiment of the pressure absorbing assembly 410. As shown, this embodiment of the pressure absorbing assembly 410 is somewhat similar to the previous embodiments. For example, the pressure absorbing assembly 410 again includes a pressure absorber 412 that is substantially similar to the previous embodiments.

However, in this embodiment, the design of the resting component 414 is somewhat different than in the previous embodiments. As shown in FIG. 4A, the resting component 414 again includes a single vertical support component 428 that is coupled to the absorber frame 422 and extends generally upward from the absorber frame 422. The vertical support component 428 again further includes a foot 428A that extends horizontally at the base of the vertical support component 428 and is configured to contact the support surface 16 (illustrated in FIG. 1A) to provide stability for the resting component 414. As illustrated, the resting component 414 further includes a central support component 430 that is adjustably coupled, e.g., with an adjuster 432, to the vertical support component 428. In this embodiment, the central support component 430 again extends substantially directly upward from the vertical support component 428. However, in this embodiment, the arms 430A of the central support component 430 are somewhat shallow U-shaped to provide the surface for the user 35 (illustrated in FIG. 10) to lean against and/or be positioned in a semi-seated position on during use of the pressure absorbing assembly 410. Stated in another manner, the central support component 430 is again configured to be selectively engaged by the user 35 during use of the pressure absorbing assembly 410.

Figure 4B:
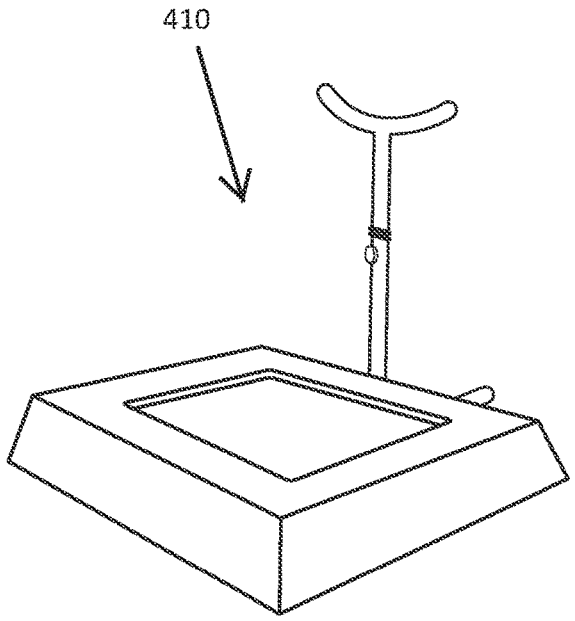
FIG. 4B is a simplified perspective view illustration of the pressure absorbing assembly illustrated in FIG. 4A.

FIG. 4B is a simplified perspective view illustration of the pressure absorbing assembly 410 illustrated in FIG. 4A.

Figure 5A:
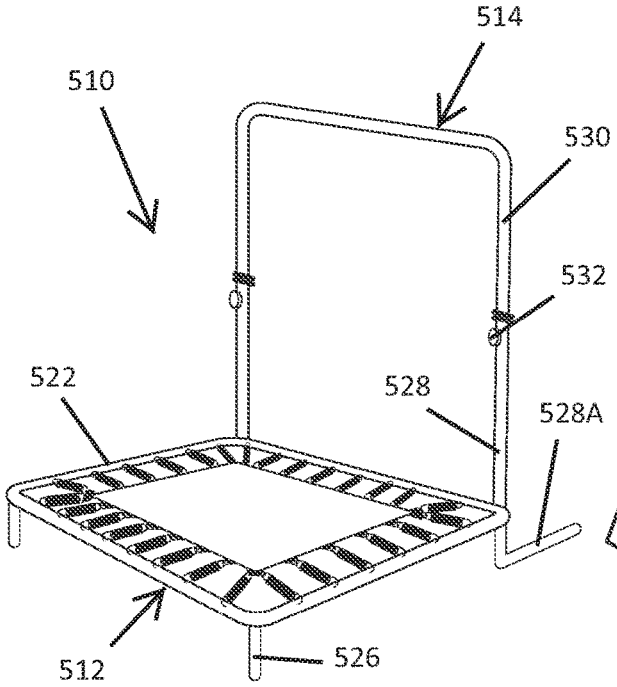
FIG. 5A is a simplified perspective view illustration of a portion of yet another embodiment of the pressure absorbing assembly.

FIG. 5A is a simplified perspective view illustration of a portion of yet another embodiment of the pressure absorbing assembly 510. As shown, this embodiment of the pressure absorbing assembly 510 is somewhat similar to the previous embodiments. For example, the pressure absorbing assembly 510 again includes a pressure absorber 512 that is substantially similar to the previous embodiments.

However, in this embodiment, the design of the resting component 514 is somewhat different than in the previous embodiments. As shown in FIG. 5A, the resting component 514 includes a pair of vertical support components 528 that are coupled to one side of the absorber frame 522 near corners of the absorber frame 522. The vertical support members 528 again extend generally upward from the absorber frame 522. The vertical support components 528 further include feet 528A that extend horizontally at the base of the vertical support components 528 and are configured to contact the support surface 16 (illustrated in FIG. 1A) to provide stability for the resting component 514. Additionally, in this embodiment, the feet 528A of the vertical support components 528 can be used to replace two of the legs 526 of the pressure absorber 512. Further, as illustrated, the resting component 514 again further includes a central support component 530 that is adjustably coupled, e.g., with one or more adjusters 532, to the vertical support components 528. In this embodiment, the central support component 530 is substantially inverted U-shaped, and extends substantially directly upward from the vertical support components 528. Additionally, as with the previous embodiments, the central support component 530 is configured to be selectively engaged by the user 35 (illustrated in FIG. 1C) during use of the pressure absorbing assembly 510.

Figure 5B:
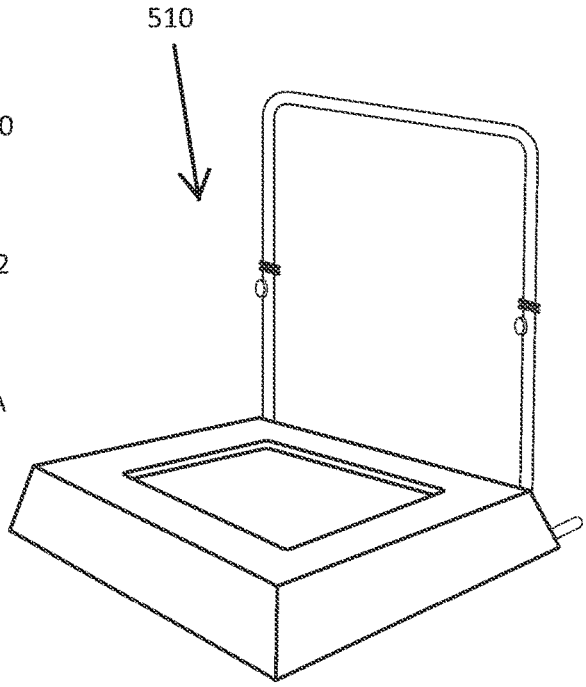
FIG. 5B is a simplified perspective view illustration of the pressure absorbing assembly illustrated in FIG. 5A.

FIG. 5B is a simplified perspective view illustration of the pressure absorbing assembly 510 illustrated in FIG. 5A.

Figure 6A:
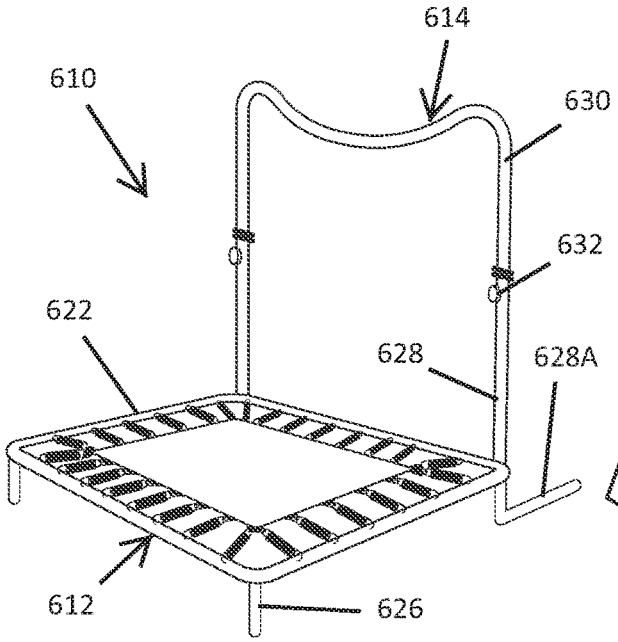
FIG. 6A is a simplified perspective view illustration of a portion of another embodiment of the pressure absorbing assembly.

FIG. 6A is a simplified perspective view illustration of a portion of another embodiment of the pressure absorbing assembly 610. As shown, this embodiment of the pressure absorbing assembly 610 is somewhat similar to the previous embodiments. For example, the pressure absorbing assembly 610 again includes a pressure absorber 612 that is substantially similar to the previous embodiments.

However, in this embodiment, the design of the resting component 614 is somewhat different than in the previous embodiments. As shown in FIG. 6A, the resting component 614 includes a pair of vertical support components 628 that are coupled to one side of the absorber frame 622 near corners of the absorber frame 622. The vertical support members 628 again extend generally upward from the absorber frame 622. The vertical support components 628 further include feet 628A that extend horizontally at the base of the vertical support components 628 and are configured to contact the support surface 16 (illustrated in FIG. 1A) to provide stability for the resting component 614. Additionally, in this embodiment, the feet 628A of the vertical support components 628 can be used to replace two of the legs 626 of the pressure absorber 612. Further, as illustrated, the resting component 614 again further includes a central support component 630 that is adjustably coupled, e.g., with one or more adjusters 632, to the vertical support components 628. In this embodiment, the central support component 630 again extends generally directly upward from the vertical support components 628, but extends horizontally in a somewhat shallow U-shape as it extends from one side to the other. With this design, the user 35 (illustrated in FIG. 1C) can engage, e.g., can lean against and/or position themselves in a semi-seated position against, the shallow U-shaped portion of the central support component 630 during use of the pressure absorbing assembly 610.

Figure 6B:
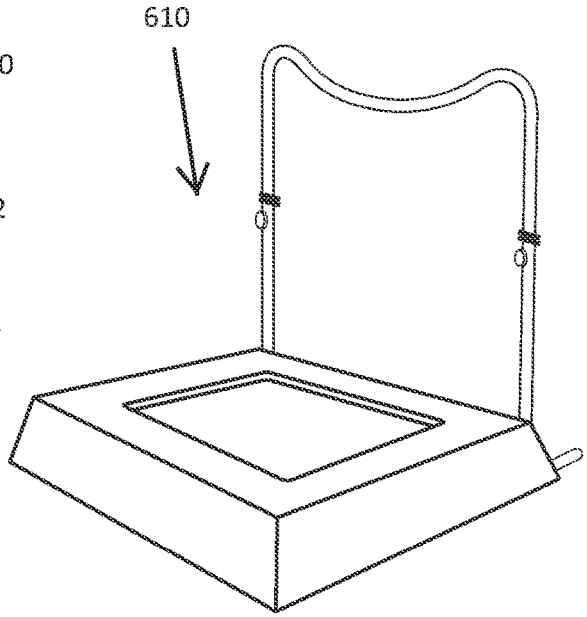
FIG. 6B is a simplified perspective view illustration of the pressure absorbing assembly illustrated in FIG. 6A.

FIG. 6B is a simplified perspective view illustration of the pressure absorbing assembly 610 illustrated in FIG. 6A.

Figure 7A:
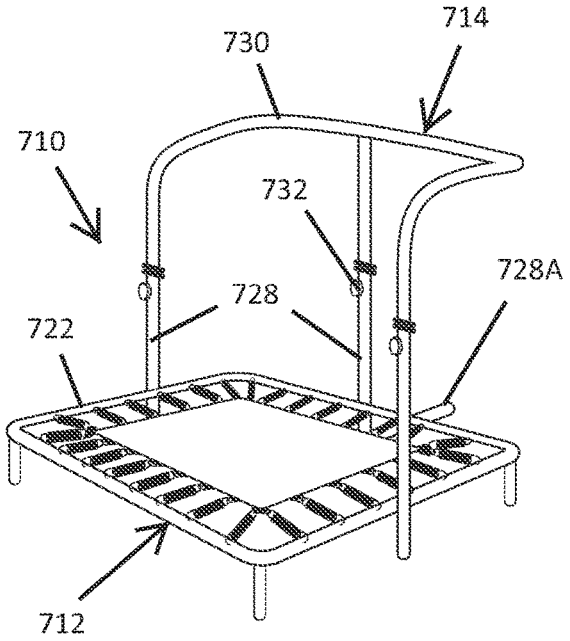
FIG. 7A is a simplified perspective view illustration of a portion of still another embodiment of the pressure absorbing assembly.

FIG. 7A is a simplified perspective view illustration of a portion of still another embodiment of the pressure absorbing assembly 710. As shown, this embodiment of the pressure absorbing assembly 710 is somewhat similar to the previous embodiments. For example, the pressure absorbing assembly 710 again includes a pressure absorber 712 that is substantially similar to the previous embodiments.

However, in this embodiment, the design of the resting component 714 is somewhat different than in the previous embodiments. As shown in FIG. 7A, the resting component 714 is similar to the embodiment shown in FIG. 1A, except the resting component 714 includes three vertical support components 728 that are coupled to the absorber frame 722. Two vertical support components 728 are coupled to opposite sides of the absorber frame 722, and the third vertical support component 728 is coupled to a third side of the absorber frame 722. The third vertical support component 728 further includes a foot 728A that extends horizontally at the base of the vertical support component 728 and is configured to contact the support surface 16 (illustrated in FIG. 1A) to provide stability for the resting component 714. Additionally, as illustrated, the resting component 714 again further includes a central support component 730 that is adjustably coupled, e.g., with one or more adjusters 732, to the vertical support components 728. Further, the central support component 730 is again configured to be selectively engaged by the user 35 (illustrated in FIG. 1C) during use of the pressure absorbing assembly 710.

Figure 7B:
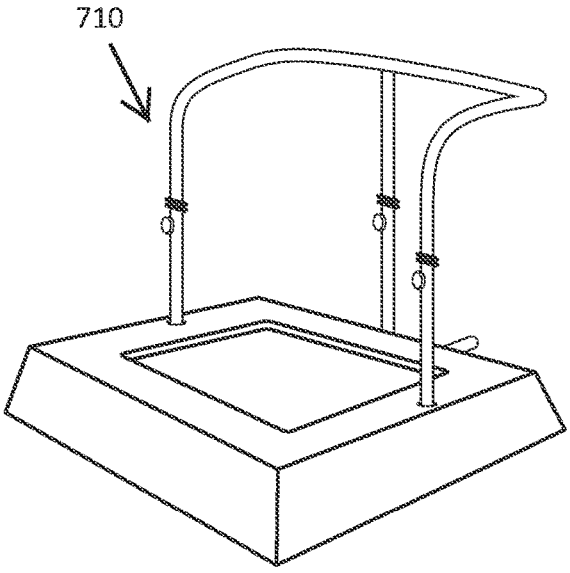
FIG. 7B is a simplified perspective view illustration of the pressure absorbing assembly illustrated in FIG. 7A.

FIG. 7B is a simplified perspective view illustration of the pressure absorbing assembly 710 illustrated in FIG. 7A.

FIG. 8A is a simplified perspective view illustration of a portion of another embodiment of the pressure absorbing assembly 810. As shown, this embodiment of the pressure absorbing assembly 810 is somewhat similar to the previous embodiments. For example, the pressure absorbing assembly 810 again includes a pressure absorber 812 that is substantially similar to the previous embodiments.

However, in this embodiment, the design of the resting component 814 is somewhat different than in the previous embodiments. As shown in FIG. 8A, the resting component 814 includes a pair of side support components 840 that are each coupled at two points to the absorber frame 822. In this embodiment, each of the side support components 840 includes two lower support members 842A and one upper support member 842B that is adjustably coupled, e.g., with adjusters 832, to each of the lower support members 842A. The lower support members 842A and the upper support member 842B cooperate to form a somewhat inverted V-shaped side support component 840 that extends substantially vertically upward from the absorber frame 822. Each side support component 840 also includes a component holder 844 that is coupled to and extends between portions of the upper support member 842B of each side support component 840. The component holder 844 provides multiple locations for holding a central support component 830, i.e. a support bar in this embodiment, such that the central support component 830 can be adjustably positioned within the component holder 844. Additionally, as with the previous embodiments, the central support component 830 is configured to be selectively engaged by the user 35 (illustrated in FIG. 1C) during use of the pressure absorbing assembly 810.

FIG. 8B is an enlarged view illustration of a portion of the pressure absorbing assembly 810 illustrated in FIG. 8A. In particular, FIG. 8B illustrates an enlarged portion of an end of the central support component 830. As shown, the end of the central support component 830 includes a recess 830A that is configured to engage the component holder 844 (illustrated in FIG. 8A).

FIG. 8C is a simplified perspective view illustration of the pressure absorbing assembly 810 illustrated in FIG. 8A.

FIG. 9A is a simplified perspective view illustration of a portion of yet another embodiment of the pressure absorbing assembly 910. As shown, this embodiment of the pressure absorbing assembly 910 is somewhat similar to the previous embodiments. For example, the pressure absorbing assembly 910 again includes a pressure absorber 912 that is substantially similar to the previous embodiments.

However, in this embodiment, the design of the resting component 914 is somewhat different than in the previous embodiments. As shown in FIG. 9A, the resting component 914 is somewhat similar to the embodiment illustrated and described in relation to FIG. 8A. However, in this embodiment, the absorber frame 922 further includes frame apertures 946 that enable alternative positions in which the side support component 940 can be coupled to the absorber frame 922. More particularly, in FIG. 9A, the side support components 940, and thus the resting component 914, are shown in a first position. The number of frame apertures 946 can be varied. For example, in this embodiment, the absorber frame 922 includes three frame apertures 946 along the opposing sides of the absorber frame 922. Alternatively, the opposing sides of the absorber frame 922 can include greater than three or less than three frame apertures 946 for providing alternative positions for the side support components 940.

FIG. 9B is an enlarged view illustration of a portion of the pressure absorbing assembly 910 illustrated in FIG. 9A. In particular, FIG. 9B illustrates an enlarged portion of an end of the central support component 930.

FIG. 9C is a simplified perspective view illustration of the portion of the pressure absorbing assembly 910 illustrated in FIG. 9A, the resting component 914 and the side support components 940 being in a second position.

FIG. 9D is a simplified perspective view illustration of the pressure absorbing assembly 910 illustrated in FIG. 9A.

Figure 10A:
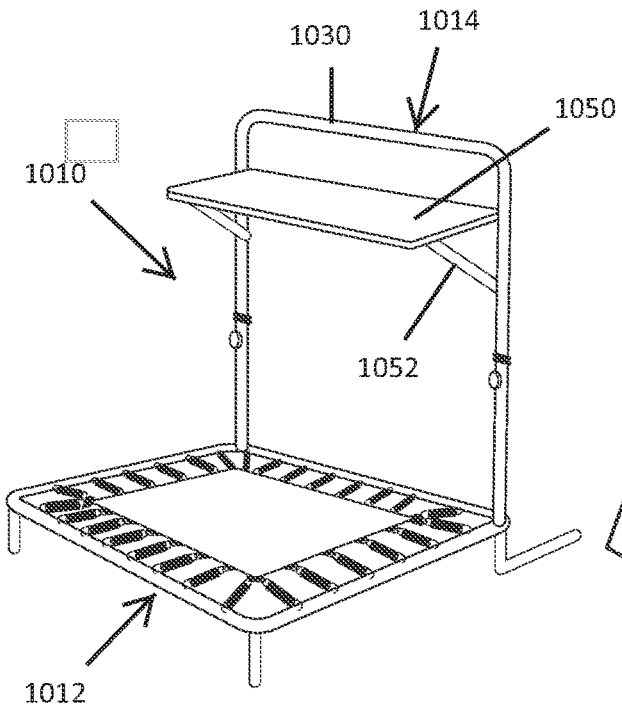
FIG. 10A is a simplified perspective view illustration of a portion of another embodiment of the pressure absorbing assembly.

FIG. 10A is a simplified perspective view illustration of a portion of another embodiment of the pressure absorbing assembly 1010. As shown, this embodiment of the pressure absorbing assembly 1010 is somewhat similar to the previous embodiments. For example, the pressure absorbing assembly 1010 again includes a pressure absorber 1012 that is substantially similar to the previous embodiments.

However, in this embodiment, the design of the resting component 1014 is somewhat different than in the previous embodiments. As shown in FIG. 10A, the resting component 1014 is somewhat similar to the embodiment illustrated and described above in relation to FIG. 5A. However, as shown, the resting component 1014 further includes a support plate 1050 that is coupled to and supported relative to the central support component 1030 with a pair of plate braces 1052. The support plate 1050 provides a seat on which the user 35 (illustrated in FIG. 1C) can rest, with the position of the support plate 1050 being adjustable in both height and depth.

Figure 10B:
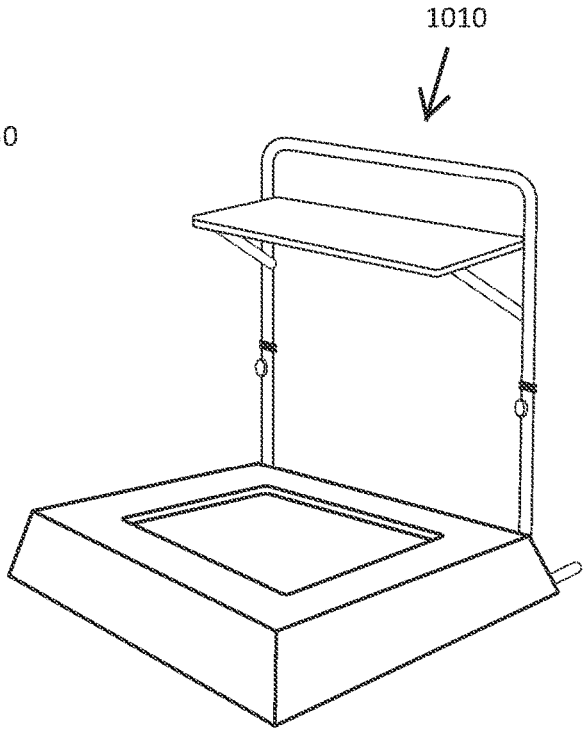
FIG. 10B is a simplified perspective view illustration of the pressure absorbing assembly illustrated in FIG. 10A.

FIG. 10B is a simplified perspective view illustration of the pressure absorbing assembly 1010 illustrated in FIG. 10A.

Figure 11A:
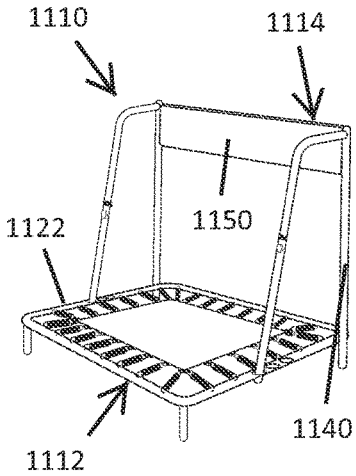
FIG. 11A is a simplified perspective view illustration of a portion of still another embodiment of the pressure absorbing assembly, the resting component being in a first position.

FIG. 11A is a simplified perspective view illustration of a portion of still another embodiment of the pressure absorbing assembly 1110. As shown, this embodiment of the pressure absorbing assembly 1110 is somewhat similar to the previous embodiments. For example, the pressure absorbing assembly 1110 again includes a pressure absorber 1112 that is substantially similar to the previous embodiments.

However, in this embodiment, the design of the resting component 1114 is somewhat different than in the previous embodiments. As shown in FIG. 11A, the resting component 1114 is somewhat similar to the embodiment illustrated and described above in relation to FIG. 9A. However, as shown, the resting component 1114 further includes a support plate 1150 that is coupled to the side support components 1140, and that can be selectively engaged by the user 35 (illustrated in FIG. 1C) during use of the pressure absorbing assembly 1110. In FIG. 11A, the support plate 1150 is in a vertical position, such that the user 35 can easily lean against the support plate 1150 during use of the pressure absorbing assembly 1110. Additionally, the side support components 1140, and thus the resting component 1114, are shown in a first position relative to the absorber frame 1122.

Figure 11B:
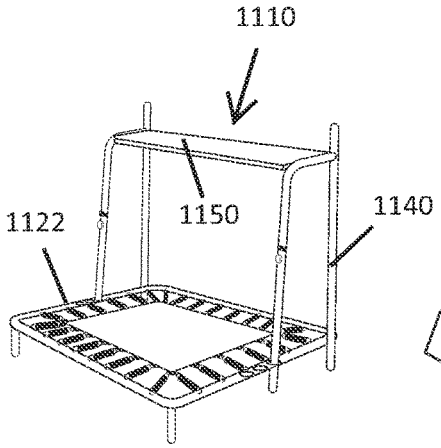
FIG. 11B is a simplified perspective view illustration of the portion of the pressure absorbing assembly illustrated in FIG. 11A, the resting component being in a second position.

FIG. 11B is a simplified perspective view illustration of the portion of the pressure absorbing assembly 1110 illustrated in FIG. 11A. As shown in FIG. 11B, the support plate 1150 is in a horizontal position such that the user 35 (illustrated in FIG. 1C) can effectively sit on top of the support plate 1150 during use of the pressure absorbing assembly 1110. Additionally, the side support components 1140, and thus the resting component 1114, are shown in a second position relative to the absorber frame 1122. Alternatively, the support plate 1150 could be configured and/or adjusted to be selectively positioned in a vertical position to be out of the way for the standing user 35.

Figure 11C:
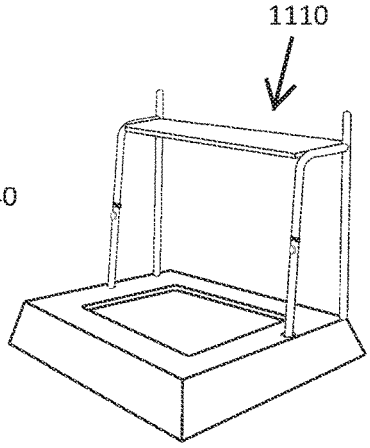
FIG. 11C is a simplified perspective view illustration of the pressure absorbing assembly illustrated in FIG. 11A.

FIG. 11C is a simplified perspective view illustration of the pressure absorbing assembly 1110 illustrated in FIG. 11A.

Figure 12A:
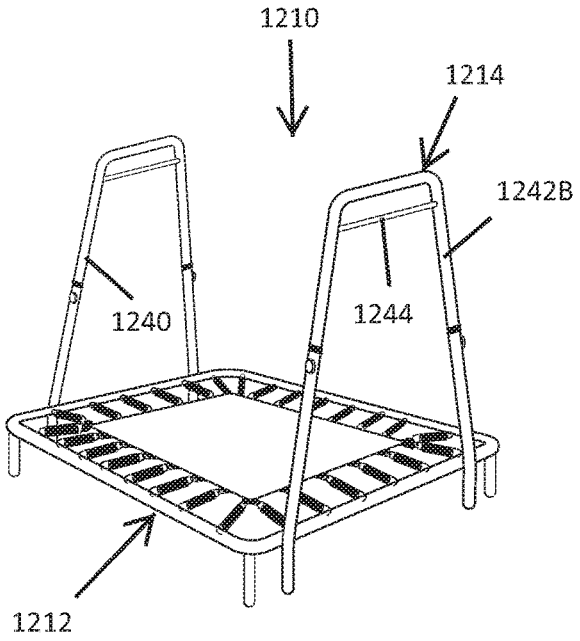
FIG. 12A is a simplified perspective view illustration of a portion of another embodiment of the pressure absorbing assembly.

FIG. 12A is a simplified perspective view illustration of a portion of another embodiment of the pressure absorbing assembly 1210. As shown, this embodiment of the pressure absorbing assembly 1210 is somewhat similar to the previous embodiments. For example, the pressure absorbing assembly 1210 again includes a pressure absorber 1212 that is substantially similar to the previous embodiments.

However, in this embodiment, the design of the resting component 1214 is somewhat different than in the previous embodiments. As shown in FIG. 12A, the resting component 1214 is somewhat similar to the embodiment illustrated and described above in relation to FIG. 8A. However, as shown, the component holder 1244 in this embodiment is a straight bar that is coupled to and extends between portions of the upper support member 1242B of each side support component 1240.

Figure 12B:
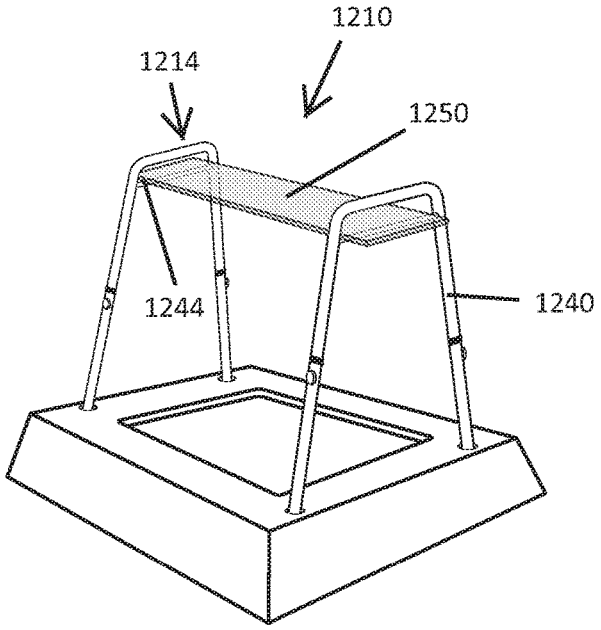
FIG. 12B is a simplified perspective view illustration of the pressure absorbing assembly illustrated in FIG. 12A.

FIG. 12B is a simplified perspective view illustration of the pressure absorbing assembly 1210 illustrated in FIG. 12A. Additionally, as illustrated, the resting component 1214 further includes a support plate 1250 that can be selectively positioned on the component holder 1244 of each side support component 1240. The support plate 1250 again provides a suitable place for the user 35 (illustrated in FIG. 1C) to rest on during use of the pressure absorbing assembly 1210.

Figure 13A:
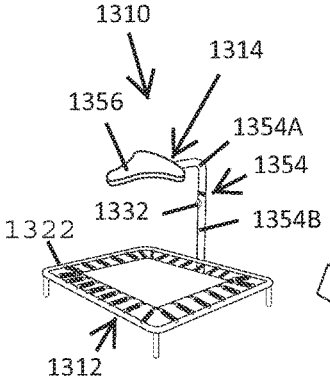
FIG. 13A is a simplified perspective view illustration of a portion of yet another embodiment of the pressure absorbing assembly.

FIG. 13A is a simplified perspective view illustration of a portion of yet another embodiment of the pressure absorbing assembly 1310. As shown, this embodiment of the pressure absorbing assembly 1310 is somewhat similar to the previous embodiments. For example, the pressure absorbing assembly 1310 again includes a pressure absorber 1312 that is substantially similar to the previous embodiments.

However, in this embodiment, the design of the resting component 1314 is somewhat different than in the previous embodiments. As shown in FIG. 13A, the resting component 1314 includes a seat support 1354 that is coupled to the absorber frame 1322, and a seat 1356 that is coupled to and supported by the seat support 1354. As shown the seat support 1354 includes a lower support member 1354A and an upper support member 1354B that is adjustably coupled, e.g., with an adjuster 1332, to the lower support member 1354A. The seat 1356 is configured to provide the user 35 (illustrated in FIG. 1C) with a place to sit, as desired, during use of the pressure absorbing assembly 1310.

Figure 13B:
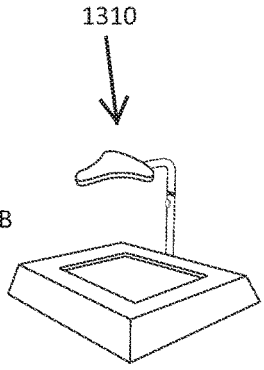
FIG. 13B is a simplified perspective view illustration of the pressure absorbing assembly illustrated in FIG. 13A.

FIG. 13B is a simplified perspective view illustration of the pressure absorbing assembly 1310 illustrated in FIG. 13A.

Figure 13C:
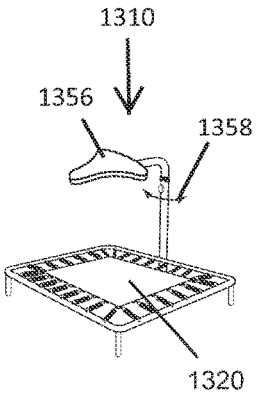
FIG. 13C is a simplified perspective view illustration of the portion of the pressure absorbing assembly illustrated in FIG. 13A, the resting component being in a first position.

FIG. 13C is a simplified perspective view illustration of the portion of the pressure absorbing assembly 1310 illustrated in FIG. 13A. FIG. 13C further includes arrow 1358 that demonstrates potential movement, e.g., rotation, of the seat 1356 relative to the pressure absorber 1312 between a first position, i.e. a seated position as shown in FIG. 13C, where the seat 1356 extends at least partially over the absorbing mat 1320 so the user 35 (illustrated in FIG. 1C) can easily sit on the seat 1356, and a second position, i.e. a standing position as shown in FIG. 13D, where the seat 1356 does not extend over the absorbing mat 1320 and is out of the way so the user 35 can easily stand on the pressure absorber 1312.

Figure 13D:
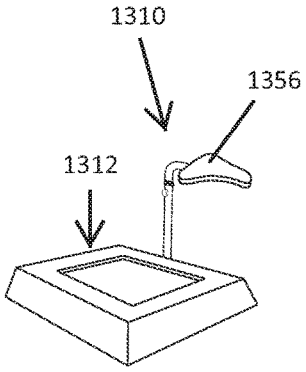
FIG. 13D is a simplified perspective view illustration of the pressure absorbing assembly illustrated in FIG. 13A, the resting component being in a second position.

FIG. 13D is a simplified perspective view illustration of the pressure absorbing assembly 1310 illustrated in FIG. 13A, with the seat 1356 of the resting component 1314 being in the second position.

Figure 14A:
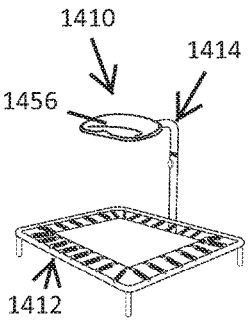
FIG. 14A is a simplified perspective view illustration of a portion of another embodiment of the pressure absorbing assembly.

FIG. 14A is a simplified perspective view illustration of a portion of another embodiment of the pressure absorbing assembly 1410. As shown, this embodiment of the pressure absorbing assembly 1410 is somewhat similar to the previous embodiments. For example, the pressure absorbing assembly 1410 again includes a pressure absorber 1412 that is substantially similar to the previous embodiments.

However, in this embodiment, the design of the resting component 1414 is somewhat different than in the previous embodiments. As shown in FIG. 14A, the resting component 1414 is somewhat similar to the embodiment illustrated and described above in relation to FIG. 13A. However, as shown, the seat 1456 in this embodiment has a slightly different design.

Figure 14B:
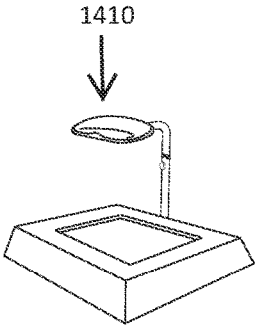
FIG. 14B is a simplified perspective view illustration of the pressure absorbing assembly illustrated in FIG. 14A.

FIG. 14B is a simplified perspective view illustration of the pressure absorbing assembly 1410 illustrated in FIG. 14A.

Figure 14C:
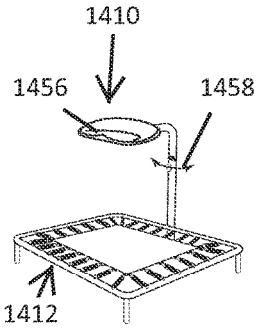
FIG. 14C is a simplified perspective view illustration of the portion of the pressure absorbing assembly illustrated in FIG. 14A, the resting component being in a first position.

FIG. 14C is a simplified perspective view illustration of the portion of the pressure absorbing assembly 1410 illustrated in FIG. 14A. FIG. 14C further includes arrow 1458 that demonstrates potential movement of the seat 1456 between a first position, i.e. a seated position as shown in FIG. 14C, where the user 35 (illustrated in FIG. 1C) can easily sit on the seat 1456, and a second position, i.e. a standing position as shown in FIG. 14D, where the seat 1456 is out of the way so the user 35 can easily stand on the pressure absorber 1412.

Figure 14D:
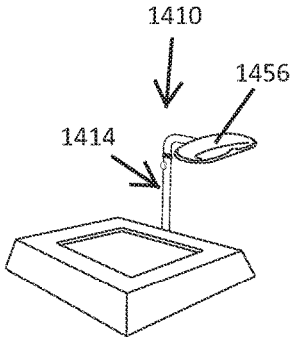
FIG. 14D is a simplified perspective view illustration of the pressure absorbing assembly illustrated in FIG. 14A, the resting component being in a second position.

FIG. 14D is a simplified perspective view illustration of the pressure absorbing assembly 1410 illustrated in FIG. 14A, with the seat 1456 of the resting component 1414 being in the second position.

Figure 15A:
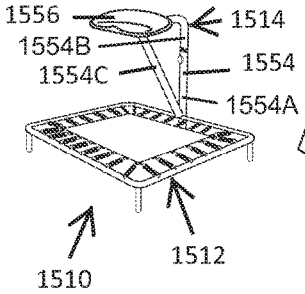
FIG. 15A is a simplified perspective view illustration of a portion of still another embodiment of the pressure absorbing assembly.

FIG. 15A is a simplified perspective view illustration of a portion of still another embodiment of the pressure absorbing assembly 1510. As shown, this embodiment of the pressure absorbing assembly 1510 is somewhat similar to the previous embodiments. For example, the pressure absorbing assembly 1510 again includes a pressure absorber 1512 that is substantially similar to the previous embodiments.

However, in this embodiment, the design of the resting component 1514 is somewhat different than in the previous embodiments. As shown in FIG. 15A, the resting component 1514 is somewhat similar to the embodiment illustrated and described above in relation to FIG. 14A. However, as shown, the seat support 1554 in this embodiment further includes a support brace 1554C to further support the seat 1556 during use of the pressure absorbing assembly 1510. In this embodiment, the support brace 1554C is coupled to and extends between the lower support member 1554A and the seat 1556. Alternatively, the support brace 1554C can be coupled to and extend between the upper support member 1554B and the seat 1556.

Figure 15B:
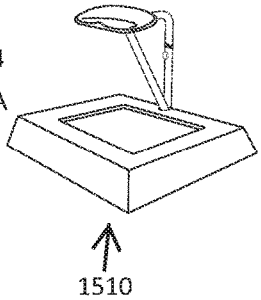
FIG. 15B is a simplified perspective view illustration of the pressure absorbing assembly illustrated in FIG. 15A.

FIG. 15B is a simplified perspective view illustration of the pressure absorbing assembly 1510 illustrated in FIG. 15A.

Figure 15C:
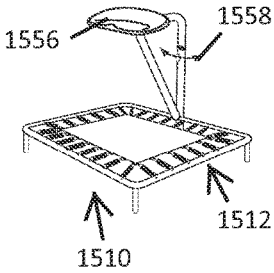
FIG. 15C is a simplified perspective view illustration of the portion of the pressure absorbing assembly illustrated in FIG. 15A, the resting component being in a first position.

FIG. 15C is a simplified perspective view illustration of the portion of the pressure absorbing assembly 1510 illustrated in FIG. 15A. FIG. 15C further includes arrow 1558 that demonstrates potential movement of the seat 1556 between a first position, i.e. a seated position as shown in FIG. 15C, where the user 35 (illustrated in FIG. 1C) can easily sit on the seat 1556, and a second position, i.e. a standing position as shown in FIG. 15D, where the seat 1556 is out of the way so the user 35 can easily stand on the pressure absorber 1512.

Figure 15D:
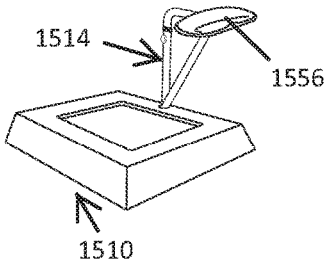
FIG. 15D is a simplified perspective view illustration of the pressure absorbing assembly illustrated in FIG. 15A, the resting component being in a second position.

FIG. 15D is a simplified perspective view illustration of the pressure absorbing assembly 1510 illustrated in FIG. 15A, with the seat 1556 of the resting component 1514 being in the second position.

Figure 16A:
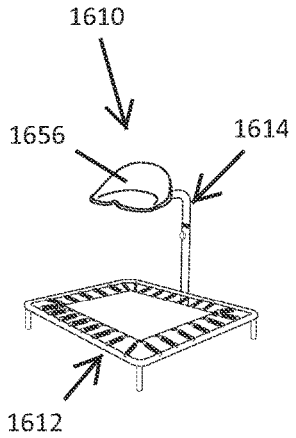
FIG. 16A is a simplified perspective view illustration of a portion of another embodiment of the pressure absorbing assembly.

FIG. 16A is a simplified perspective view illustration of a portion of another embodiment of the pressure absorbing assembly 1610. As shown, this embodiment of the pressure absorbing assembly 1610 is somewhat similar to the previous embodiments. For example, the pressure absorbing assembly 1610 again includes a pressure absorber 1612 that is substantially similar to the previous embodiments.

However, in this embodiment, the design of the resting component 1614 is somewhat different than in the previous embodiments. As shown in FIG. 16A, the resting component 1614 is somewhat similar to the embodiment illustrated and described above in relation to FIG. 13A. However, as shown, the seat 1656 in this embodiment has a slightly different design.

Figure 16B:
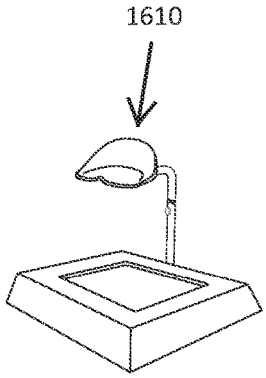
FIG. 16B is a simplified perspective view illustration of the pressure absorbing assembly illustrated in FIG. 16A.

FIG. 16B is a simplified perspective view illustration of the pressure absorbing assembly 1610 illustrated in FIG. 16A.

Figure 16C:
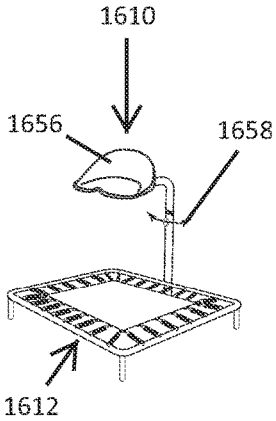
FIG. 16C is a simplified perspective view illustration of the portion of the pressure absorbing assembly illustrated in FIG. 16A, the resting component being in a first position.

FIG. 16C is a simplified perspective view illustration of the portion of the pressure absorbing assembly 1610 illustrated in FIG. 16A. FIG. 16C further includes arrow 1658 that demonstrates potential movement of the seat 1656 between a first position, i.e. a seated position as shown in FIG. 16C, where the user 35 (illustrated in FIG. 1C) can easily sit on the seat 1656, and a second position, i.e. a standing position as shown in FIG. 16D, where the seat 1656 is out of the way so the user 35 can easily stand on the pressure absorber 1612.

Figure 16D:
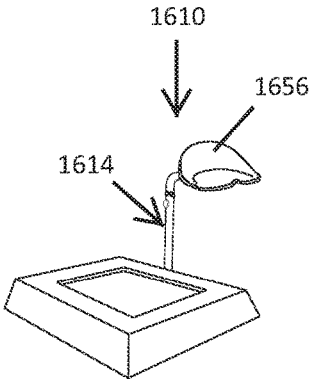
FIG. 16D is a simplified perspective view illustration of the pressure absorbing assembly illustrated in FIG. 16A, the resting component being in a second position.

FIG. 16D is a simplified perspective view illustration of the pressure absorbing assembly 1610 illustrated in FIG. 16A, with the seat 1656 of the resting component 1614 being in the second position.

Figure 17A:
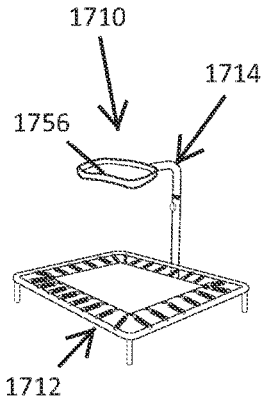
FIG. 17A is a simplified perspective view illustration of a portion of yet another embodiment of the pressure absorbing assembly.

FIG. 17A is a simplified perspective view illustration of a portion of yet another embodiment of the pressure absorbing assembly 1710. As shown, this embodiment of the pressure absorbing assembly 1710 is somewhat similar to the previous embodiments. For example, the pressure absorbing assembly 1710 again includes a pressure absorber 1712 that is substantially similar to the previous embodiments.

However, in this embodiment, the design of the resting component 1714 is somewhat different than in the previous embodiments. As shown in FIG. 17A, the resting component 1714 is somewhat similar to the embodiment illustrated and described above in relation to FIG. 13A. However, as shown, the seat 1756 in this embodiment has a slightly different design.

Figure 17B:
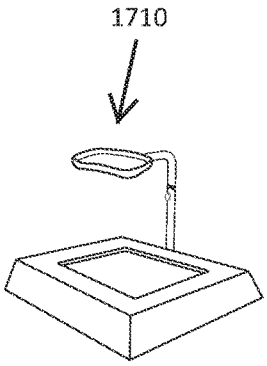
FIG. 17B is a simplified perspective view illustration of the pressure absorbing assembly illustrated in FIG. 17A.

FIG. 17B is a simplified perspective view illustration of the pressure absorbing assembly 1710 illustrated in FIG. 17A.

Figure 17C:
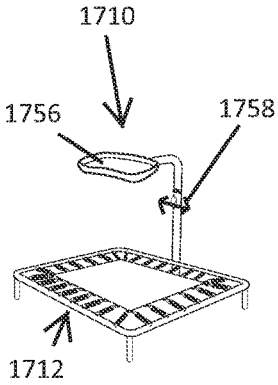
FIG. 17C is a simplified perspective view illustration of the portion of the pressure absorbing assembly illustrated in FIG. 17A, the resting component being in a first position.

FIG. 17C is a simplified perspective view illustration of the portion of the pressure absorbing assembly 1710 illustrated in FIG. 17A. FIG. 17C further includes arrow 1758 that demonstrates potential movement of the seat 1756 between a first position, i.e. a seated position as shown in FIG. 17C, where the user 35 (illustrated in FIG. 1C) can easily sit on the seat 1756, and a second position, i.e. a standing position as shown in FIG. 17D, where the seat 1756 is out of the way so the user 35 can easily stand on the pressure absorber 1712.

Figure 17D:
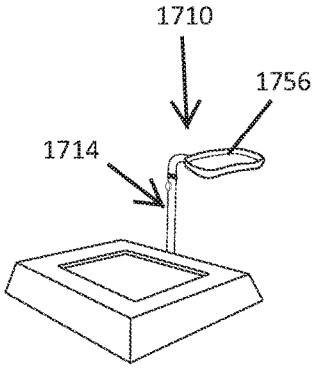
FIG. 17D is a simplified perspective view illustration of the pressure absorbing assembly illustrated in FIG. 17A, the resting component being in a second position.

FIG. 17D is a simplified perspective view illustration of the pressure absorbing assembly 1710 illustrated in FIG. 17A, with the seat 1756 of the resting component 1714 being in the second position.

Figure 18A:
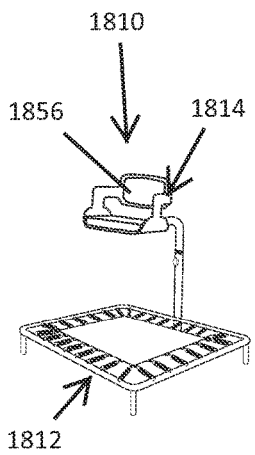
FIG. 18A is a simplified perspective view illustration of a portion of another embodiment of the pressure absorbing assembly.

FIG. 18A is a simplified perspective view illustration of a portion of another embodiment of the pressure absorbing assembly 1810. As shown, this embodiment of the pressure absorbing assembly 1810 is somewhat similar to the previous embodiments. For example, the pressure absorbing assembly 1810 again includes a pressure absorber 1812 that is substantially similar to the previous embodiments.

However, in this embodiment, the design of the resting component 1814 is somewhat different than in the previous embodiments. As shown in FIG. 18A, the resting component 1814 is somewhat similar to the embodiment illustrated and described above in relation to FIG. 13A. However, as shown, the seat 1856 in this embodiment has a slightly different design.

Figure 18B:
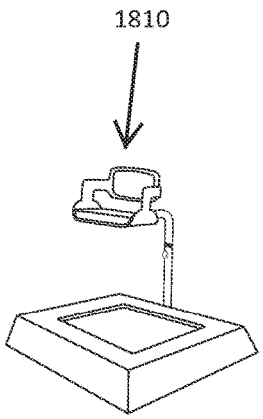
FIG. 18B is a simplified perspective view illustration of the pressure absorbing assembly illustrated in FIG. 18A.

FIG. 18B is a simplified perspective view illustration of the pressure absorbing assembly 1810 illustrated in FIG. 18A.

Figure 18C:
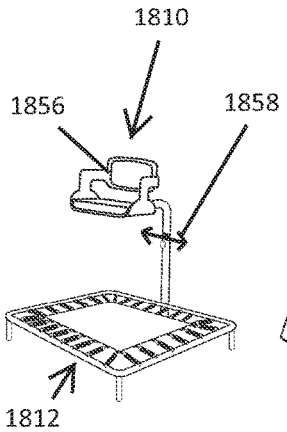
FIG. 18C is a simplified perspective view illustration of the portion of the pressure absorbing assembly illustrated in FIG. 18A, the resting component being in a first position.

FIG. 18C is a simplified perspective view illustration of the portion of the pressure absorbing assembly 1810 illustrated in FIG. 18A. FIG. 18C further includes arrow 1858 that demonstrates potential movement of the seat 1856 between a first position, i.e. a seated position as shown in FIG. 18C, where the user 35 (illustrated in FIG. 1C) can easily sit on the seat 1856, and a second position, i.e. a standing position as shown in FIG. 18D, where the seat 1856 is out of the way so the user 35 can easily stand on the pressure absorber 1812.

Figure 18D:
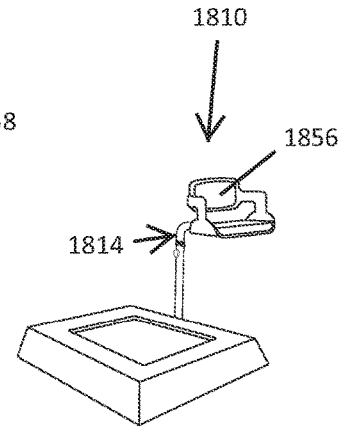
FIG. 18D is a simplified perspective view illustration of the pressure absorbing assembly illustrated in FIG. 18A, the resting component being in a second position.

FIG. 18D is a simplified perspective view illustration of the pressure absorbing assembly 1810 illustrated in FIG. 18A, with the seat 1856 of the resting component 1814 being in the second position.

Figure 19A:
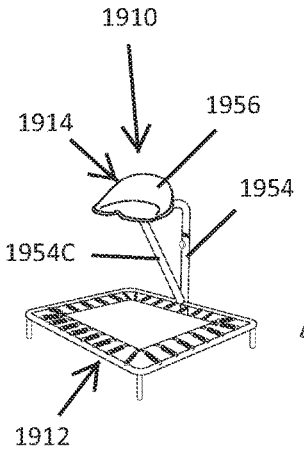
FIG. 19A is a simplified perspective view illustration of a portion of still another embodiment of the pressure absorbing assembly.

FIG. 19A is a simplified perspective view illustration of a portion of still another embodiment of the pressure absorbing assembly 1910. As shown, this embodiment of the pressure absorbing assembly 1910 is somewhat similar to the previous embodiments. For example, the pressure absorbing assembly 1910 again includes a pressure absorber 1912 that is substantially similar to the previous embodiments.

However, in this embodiment, the design of the resting component 1914 is somewhat different than in the previous embodiments. As shown in FIG. 19A, the resting component 1914 is somewhat similar to the embodiments illustrated and described above in relation to FIGS. 15A and 16A. For example, as shown, the seat support 1954 in this embodiment again further includes a support brace 1954C to further support the seat 1956 during use of the pressure absorbing assembly 1910, similar to what is shown and described in relation to FIG. 15A. Additionally, the design of the seat 1956 is substantially similar to what is shown and described in relation to FIG. 16A.

Figure 19B:
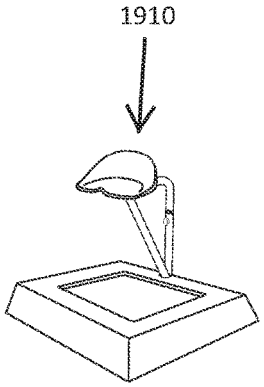
FIG. 19B is a simplified perspective view illustration of the pressure absorbing assembly illustrated in FIG. 19A.

FIG. 19B is a simplified perspective view illustration of the pressure absorbing assembly 1910 illustrated in FIG. 19A.

Figure 19C:
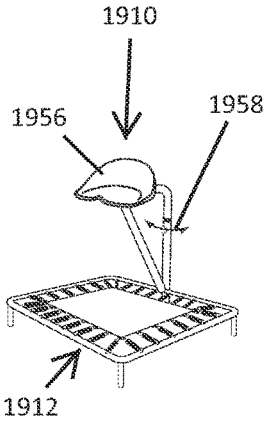
FIG. 19C is a simplified perspective view illustration of the portion of the pressure absorbing assembly illustrated in FIG. 19A, the resting component being in a first position.

FIG. 19C is a simplified perspective view illustration of the portion of the pressure absorbing assembly 1910 illustrated in FIG. 19A. FIG. 19C further includes arrow 1958 that demonstrates potential movement of the seat 1956 between a first position, i.e. a seated position as shown in FIG. 19C, where the user 35 (illustrated in FIG. 1C) can easily sit on the seat 1956, and a second position, i.e. a standing position as shown in FIG. 19D, where the seat 1956 is out of the way so the user 35 can easily stand on the pressure absorber 1912.

Figure 19D:
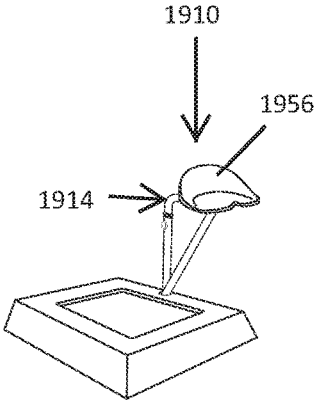
FIG. 19D is a simplified perspective view illustration of the pressure absorbing assembly illustrated in FIG. 19A, the resting component being in a second position.

FIG. 19D is a simplified perspective view illustration of the pressure absorbing assembly 1910 illustrated in FIG. 19A, with the seat 1956 of the resting component 1914 being in the second position.

Figure 20A:
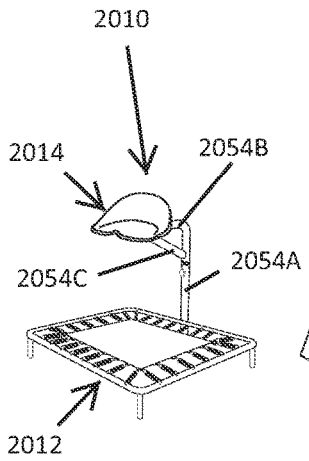
FIG. 20A is a simplified perspective view illustration of a portion of yet another embodiment of the pressure absorbing assembly.

FIG. 20A is a simplified perspective view illustration of a portion of yet another embodiment of the pressure absorbing assembly 2010. As shown, this embodiment of the pressure absorbing assembly 2010 is somewhat similar to the previous embodiments. For example, the pressure absorbing assembly 2010 again includes a pressure absorber 2012 that is substantially similar to the previous embodiments.

However, in this embodiment, the design of the resting component 2014 is somewhat different than in the previous embodiments. As shown in FIG. 20A, the resting component 2014 is somewhat similar to the embodiment illustrated and described above in relation to FIG. 19A. However, as shown, the support brace 2054C in this embodiment is positioned in a slightly different manner than in the previous embodiment. More particularly, the support brace 2054C is directly coupled to the upper support member 2054B rather than being directly coupled to the lower support member 2054A.

Figure 20B:
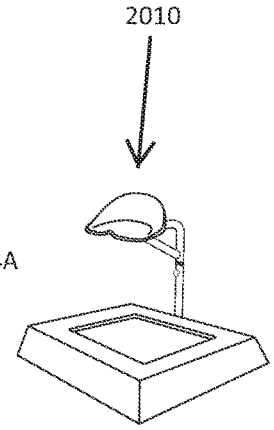
FIG. 20B is a simplified perspective view illustration of the pressure absorbing assembly illustrated in FIG. 20A.

FIG. 20B is a simplified perspective view illustration of the pressure absorbing assembly 2010 illustrated in FIG. 20A.

Figure 20C:
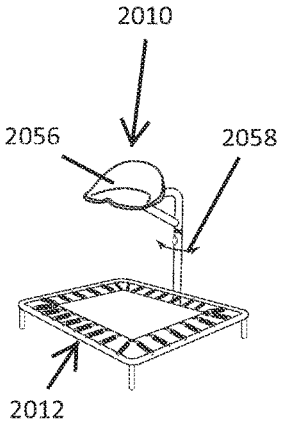
FIG. 20C is a simplified perspective view illustration of the portion of the pressure absorbing assembly illustrated in FIG. 20A, the resting component being in a first position.

FIG. 20C is a simplified perspective view illustration of the portion of the pressure absorbing assembly 2010 illustrated in FIG. 20A. FIG. 20C further includes arrow 2058 that demonstrates potential movement of the seat 2056 between a first position, i.e. a seated position as shown in FIG. 20C, where the user 35 (illustrated in FIG. 1C) can easily sit on the seat 2056, and a second position, i.e. a standing position as shown in FIG. 20D, where the seat 2056 is out of the way so the user 35 can easily stand on the pressure absorber 2012.

Figure 20D:
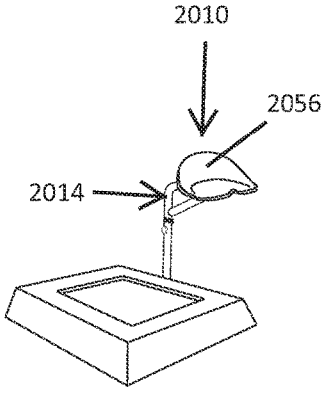
FIG. 20D is a simplified perspective view illustration of the pressure absorbing assembly illustrated in FIG. 20A, the resting component being in a second position.

FIG. 20D is a simplified perspective view illustration of the pressure absorbing assembly 2010 illustrated in FIG. 20A, with the seat 2056 of the resting component 2014 being in the second position.

Figure 21:
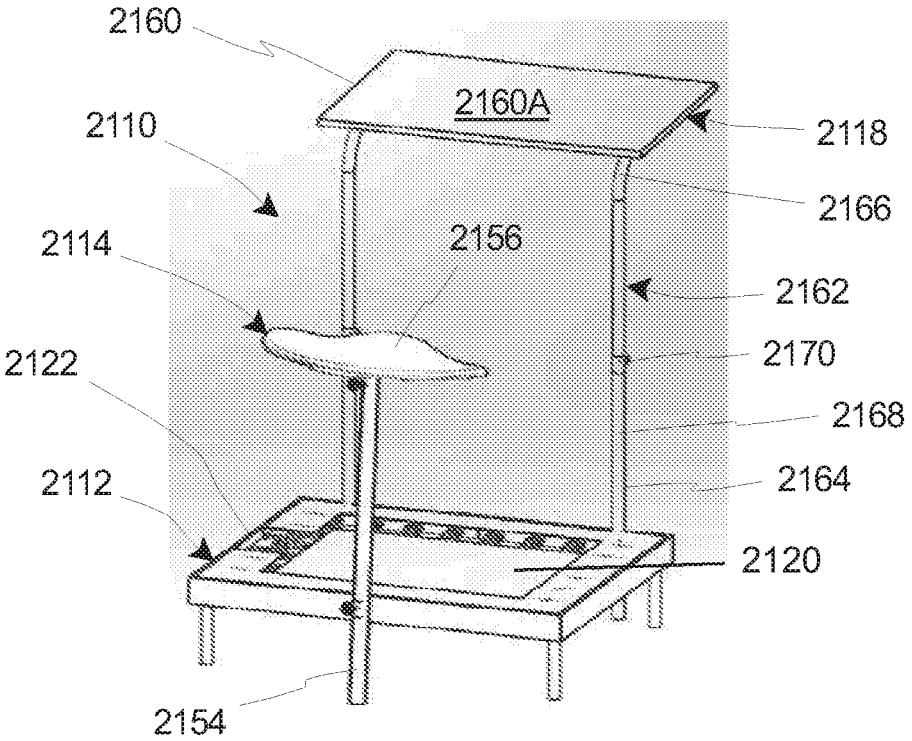
FIG. 21 is a simplified perspective view illustration of another embodiment of the pressure absorbing assembly.

FIG. 21 is a simplified perspective view illustration of another embodiment of the pressure absorbing assembly 2110. As shown, this embodiment of the pressure absorbing assembly 2110 is somewhat similar to the previous embodiments. For example, the pressure absorbing assembly 2110 again includes a pressure absorber 2112 that is substantially similar to the previous embodiments.

Additionally, in this embodiment, the resting component 2114 also includes a seat support 2154 that is coupled to and extends generally upwardly away from the absorber frame 2122, and a seat 2156 that is coupled to the seat support 2154. In some embodiments, the resting component 2114 is adjustable, such that the seat 2156 can be alternatively positioned at different heights relative to the absorbing mat 2120 and/or the absorber frame 2122.

Further, as shown in this embodiment, the pressure absorbing assembly 2110 also includes a work station 2118, i.e. a desk assembly in this embodiment, that is fixedly coupled to the pressure absorber 2112. The design of the desk assembly 2118 can be varied to suit the specific requirements of the pressure absorbing assembly 2110. In various embodiments, as shown in the embodiment illustrated in FIG. 21, the desk assembly 2118 includes a desktop 2160 and a desk support assembly 2162 that supports the desktop 2160 above the support surface 16 (illustrated in FIG. 1A). Alternatively, the desk assembly 2118 can have another suitable design.

The desktop 2160 is configured to provide a working surface 2160A for the user 35 (illustrated in FIG. 1C) of the pressure absorbing assembly 2110. It is understood that the working surface 2160A can be utilized to support any suitable materials depending upon the needs of the user 35. For example, the working surface 2160A can be utilized to support a laptop computer, a tablet computer, a monitor or other type of video screen, books, papers, or any other suitable materials. In some embodiments, the desk assembly 2118 can further include a device mount assembly (not shown) that is coupled to or otherwise secured to the desktop 2160 of the desk assembly 2118. The device mount assembly can be utilized for purposes of mounting any suitable devices in relation to the desktop 2160 for use by the user 35 of the pressure absorbing assembly 2110. For example, in one non-exclusive alternative embodiment, the device mount assembly can be utilized to mount a computer monitor (not shown) or other suitable video device relative to the working surface 2160A of the desktop 2160.

The design, i.e. the size and shape, of the desktop 2160 can be varied to suit the specific requirements of the desk assembly 2118. In some embodiments, as illustrated in FIG. 21, the desktop 2160 can be substantially rectangle-shaped and can have any suitable dimensions. Alternatively, the desktop 2160 can have another suitable shape.

As noted, the desk support assembly 2162 is configured to support the desktop 2160 above the support surface 16. Additionally, as provided herein, the desk support assembly 2162 can be coupled to the pressure absorber 2112, i.e. to the absorber frame 2122 of the pressure absorber 2112. In some embodiments, the desk support assembly 2162 is directly coupled to the absorber frame 2122 of the pressure absorber 2112.

The design of the desk support assembly 2162 can be varied to suit the requirements of the desk assembly 2118. In the embodiment illustrated in FIG. 21, the desk support assembly 2162 includes a pair of spaced apart desk supports 2164, with each desk support 2164 including an upper support member 2166, and at least one vertical support member 2168.

In many embodiments, the desk supports 2164 can be substantially similar in design and function. As shown in FIG. 21, for each desk support 2164, the upper support member 2166 is coupled to the desktop 2160, i.e. to a bottom surface of the desktop 2160. In certain embodiments, the desktop 2160 is fixedly coupled to the upper support member 2166 of the desk support 2164 so that the desktop 2160 does not move laterally relative to the pressure absorber 2112. Alternatively, in other embodiments, the desktop 2160 can be movably, e.g., slidably, coupled to the upper support member 2166 so that the position of the desktop 2160 can be adjusted horizontally (e.g., forward and/or backward) relative to the pressure absorber 2112. Stated in another manner, in such alternative embodiments, the position of the desktop 2160 can be adjusted so that the desktop 2160 is positioned more or less over the pressure absorber 2112. For example, in some such embodiments, the desk assembly 2118 can further include a pair of guide members (not shown), with each guide member being configured to movingly, e.g., slidingly, engage one of the upper support members 2166.

Additionally, in certain embodiments, the upper support member 2166 can be curved so as to more directly support a greater portion of the desktop 2160. In this embodiment, the upper support member 2166 is configured to curve away from the pressure absorber 2112. Alternatively, the upper support member 2166 can be configured to curve toward the pressure absorber 2112.

Further, for each desk support 2164, the upper support member 2166 is also coupled to the at least one vertical support member 2168. As shown, the at least one vertical support member 2168 extends between the upper support member 2166 and the support surface 16.

In the embodiment illustrated in FIG. 21, each desk support 2164 includes two vertical support members 2168 that are adjustably coupled to one another with an adjuster 2170. For example, in one non-exclusive embodiment, the vertical support members 2168 can be telescopingly coupled to one another. Alternatively, the vertical support members 2168 can be adjustably coupled to one another in a different manner.

The vertical support members 2168 are adjustable relative to one another such that the position, or height, of the desktop 2160 can be selectively adjusted relative to the support surface 16. The adjuster 2170 is configured to alternatively allow for relative movement between the vertical support members 2168, and to lock the position of the vertical support members 2168 relative to one another. In some embodiments, the vertical support members 2168 are adjustable relative to one another in a plurality of discrete positions, such that the desktop 2160 can be alternatively positioned at certain discrete heights, including an uppermost height and a lowermost height. Alternatively, in other embodiments, the vertical support members 2168 can be adjustable relative to one another along a continuum, such that the desktop 2160 can be alternatively positioned at any desired height along the continuum between the uppermost height and the lowermost height.

Further, for each desk support 2164, the vertical support members 2168 are coupled, e.g., directly coupled, to the absorber frame 2122 of the pressure absorber 2112. As such, the desk assembly 2118 and the pressure absorber 2112 can form the desired integrated unit of the pressure absorbing assembly 2110. In some such embodiments, the vertical support members 2168 for each desk support 2164 can be coupled to the absorber frame 2122 of the pressure absorber 2112 with a frame coupler (not shown). The frame coupler can have any suitable design. For example, in some embodiments, the frame coupler includes a bolt and nut combination that can be used to couple the vertical support members 2168 to the absorber frame 2122. Alternatively, the frame coupler can have another suitable design.

Further, it is appreciated that the desktop 2160 can be positioned at any suitable or desired height relative to the absorber frame 2122, and/or relative to the support surface 16 (illustrated in FIG. 1A). For example, in some non-exclusive embodiments, the height of the desktop 2160 can be adjustable to be positioned at a desk height of between approximately seventy-five centimeters and one hundred forty centimeters relative to the absorber frame 2122; and/or the desktop 2160 can be positioned at a total desk height of between approximately ninety centimeters and one hundred seventy-five centimeters relative to the support surface 16. Alternatively, the desktop 2160 can be positioned at different heights relative to the absorber frame 2122 and/or the support surface 16.

Additionally, it is further appreciated that in various non-exclusive, alternative embodiments, the desk assembly 2118 can include one or more additional features and/or components that can enhance the overall use of the desk assembly 2118, and can thus provide additional capabilities for the pressure absorbing assembly 2110. For example, in one such non-exclusive, alternative embodiment, the desk assembly 2118 can include a pair of handles (not shown) that are coupled to the desktop 2160, with each handle being coupled to the desktop 2160 near or substantially adjacent to one of the desk supports 2164. The handles can be utilized by the user 35 of the pressure absorbing assembly 2110 to enhance their stability when standing on the pressure absorber 2112. Additionally and/or alternatively, in other such non-exclusive embodiments, the desk assembly 2118 can include a second desktop (not shown) that is coupled to the desk support assembly 2162, e.g., to one of the vertical support members 2168 of each of the desk supports 2164. The second desktop can be positioned to provide a second, alternative working surface for the user 35 of the pressure absorbing assembly 2110.

Figure 22:
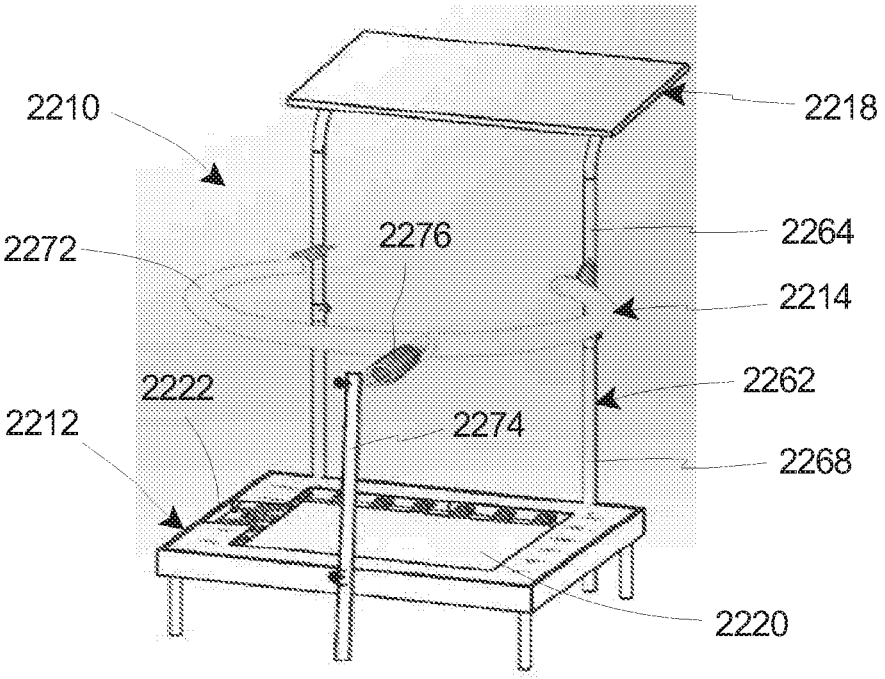
FIG. 22 is a simplified perspective view illustration of yet another embodiment of the pressure absorbing assembly.

FIG. 22 is a simplified perspective view illustration of yet another embodiment of the pressure absorbing assembly 2210. As shown, this embodiment of the pressure absorbing assembly 2210 is somewhat similar to the previous embodiments. For example, the pressure absorbing assembly 2210 again includes a pressure absorber 2212 that is substantially similar to the previous embodiments. Additionally, as shown, the pressure absorbing assembly 2210 can include a desk assembly 2218 that is substantially similar to the desk assembly 2118 illustrated and described in relation to FIG. 21.

However, in this embodiment, the design of the resting component 2214 is somewhat different than in the previous embodiments. As shown in FIG. 22A, the resting component 2214 includes a support bar 2272, a support post 2274, and a plurality of support resilient members 2276.

The support bar 2272 is positioned above the absorbing mat 2220 of the pressure absorber 2212 to provide the user 35 (illustrated in FIG. 1C) with a stabilizer to enhance balance and coordination when positioned on the pressure absorber 2212. As shown, the support bar 2272 can be positioned substantially horizontally and parallel to the absorbing mat 2220 of the pressure absorber 2212. In one embodiment, as shown in FIG. 22, the support bar 2272 can be substantially C-shaped. Alternatively, the support bar 2272 can be substantially U-shaped, substantially rectangle-shaped with one side or most of one side open or missing, substantially square-shaped with one side or most of one side open or missing, or some other shape.

The support post 2274 is resiliently coupled to the support bar 2272 and helps to support the support bar 2272 above the absorbing mat 2220. Additionally, the support post 2274 is further coupled to the absorber frame 2222. Further, as shown, the support post 2274 can extend vertically between the support bar 2272 and the support surface 16 (illustrated in FIG. 1A).

In some embodiments, as illustrated in FIG. 22, the plurality of support resilient members 2276 connect the support bar 2272 to the vertical support members 2268 of the desk support assembly 2262 and to the support post 2274. In particular, in this embodiment, the resting component 2214 includes three support resilient members 2276, with one support resilient member 2276 resiliently connecting the support bar 2272 to a vertical support member 2268 of each of the desk supports 2264, and one support resilient member 2276 resiliently connecting the support bar 2272 to the support post 2274. Alternatively, the resting component 2214 can be designed to include greater than three or less than three support resilient members 2276.

Each support resilient member 2276 can include a spring, elastic, plastic, rubber, or other suitably resilient structure. Further, in some embodiments, each support resilient member 2276 can include a support cover (not shown) that is designed to help protect the user 35 from injury by preventing the user 35 from getting hands or feet or other body parts caught or pinched within the support resilient member 2276. The support cover can be made of nylon or other suitable, pliable material.

Figure 23:
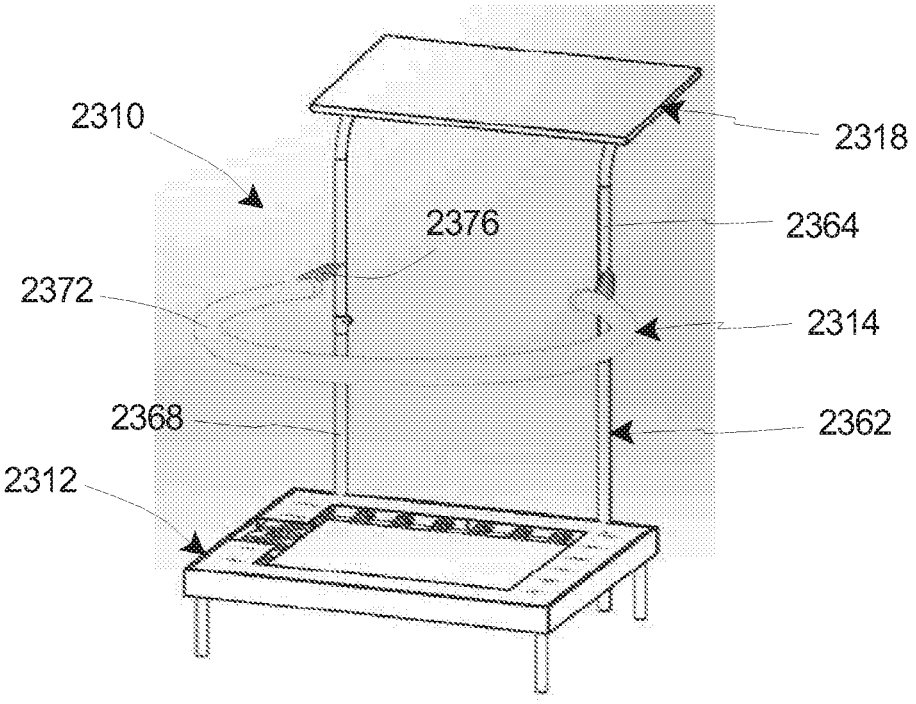
FIG. 23 is a simplified perspective view illustration of another embodiment of the pressure absorbing assembly.

FIG. 23 is a simplified perspective view illustration of another embodiment of the pressure absorbing assembly 2310. As shown, this embodiment of the pressure absorbing assembly 2310 is somewhat similar to the previous embodiments. For example, the pressure absorbing assembly 2310 again includes a pressure absorber 2312 that is substantially similar to the previous embodiments. Additionally, as shown, the pressure absorbing assembly 2310 can include a desk assembly 2318 that is substantially similar to the previous embodiments.

However, in this embodiment, the design of the resting component 2314 is somewhat different than in the previous embodiments. As shown in FIG. 23, the resting component 2314 is somewhat similar to the resting component 2214 illustrated and described in relation to FIG. 22. More particularly, the resting component 2314 again includes a support bar 2372 and a plurality or support resilient members 2376 that are substantially similar in design and function to what was shown in described in relation to FIG. 22. In this embodiment, the resting component 2314 does not include a support post such as was included in the embodiment shown in FIG. 22. Additionally, in this embodiment, only two support resilient members 2376 are included, with one support resilient member 2376 resiliently connecting the support bar 2372 to a vertical support member 2368 of each of the desk supports 2364 of the desk support assembly 2362.

Figure 24:
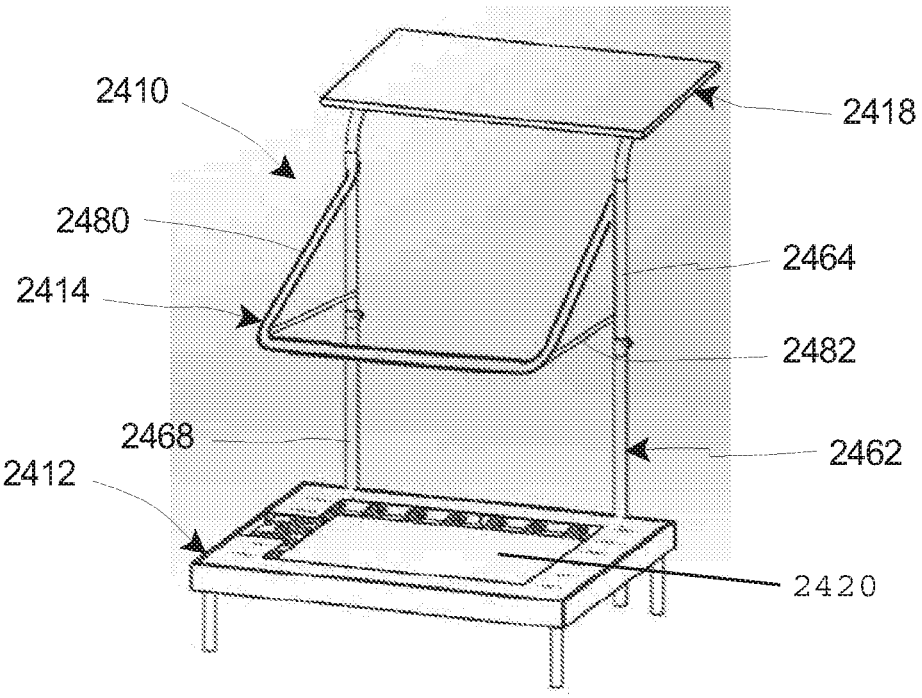
FIG. 24 is a simplified perspective view illustration of still another embodiment of the pressure absorbing assembly.

FIG. 24 is a simplified perspective view illustration of still another embodiment of the pressure absorbing assembly 2410. As shown, this embodiment of the pressure absorbing assembly 2410 is somewhat similar to the previous embodiments. For example, the pressure absorbing assembly 2410 again includes a pressure absorber 2412 that is substantially similar to the previous embodiments. Additionally, as shown, the pressure absorbing assembly 2410 can include a desk assembly 2418 that is substantially similar to the previous embodiments.

However, in this embodiment, the design of the resting component 2414 is somewhat different than in the previous embodiments. As shown in FIG. 24, the resting component 2414 includes a seating bar 2480 and a pair of spaced apart seat supports 2482.

The seating bar 2480 provides a place for the user 35 (illustrated in FIG. 1C) to sit and rest during use of the pressure absorbing assembly 2410. As illustrated, the seating bar 2480 is substantially U-shaped and is coupled to and/or integrally formed with each of the desk supports 2464 of the desk support assembly 2462. More specifically, the seating bar 2480 is coupled to and/or integrally formed with each of the desk supports 2464 near a top of the vertical support members 2468. Additionally, the seating bar 2480 extends somewhat outward at an angle over the absorbing mat 2420 of the pressure absorber 2412 as it extends downward from the desk support assembly 2462. Alternatively, the seating bar 2480 can have another suitable design and/or the seating bar 2480 can be connected to the desk support assembly 2462 in a different manner or in a different location.

The seat supports 2482 are coupled to and extend between the seating bar 2480, i.e. near the corners at the base of the U-shaped seating bar 2480, and the vertical support members 2468. The seat supports 2482 help to maintain the position of the seating bar 2480 relative to the desk support assembly 2462. In certain embodiments, each of the seat supports 2482 is a thin metal rod that extends between the seating bar 2480 and the vertical support members 2468. Alternatively, the seat supports 2482 can have a different design and/or be positioned in a different manner.

Figure 25:
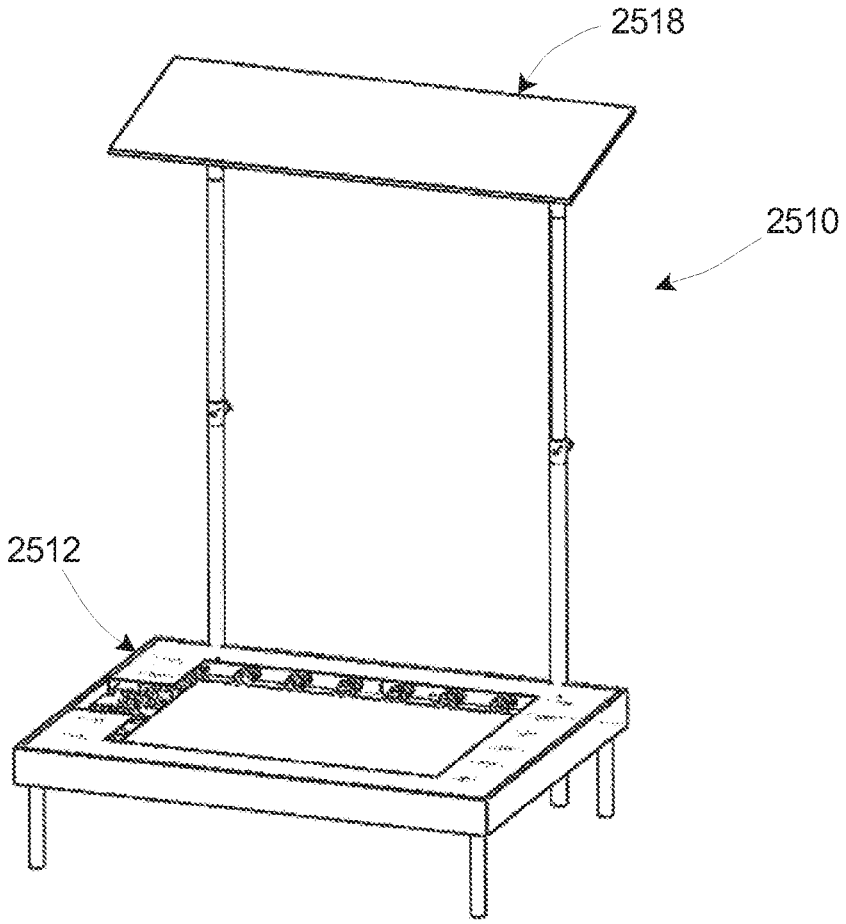
FIG. 25 is a simplified perspective view illustration of yet another embodiment of the pressure absorbing assembly.

FIG. 25 is a simplified perspective view illustration of yet another embodiment of the pressure absorbing assembly 2510. As shown, this embodiment of the pressure absorbing assembly 2510 is somewhat similar to the previous embodiments. For example, the pressure absorbing assembly 2510 again includes a pressure absorber 2512 that is substantially similar to the previous embodiments. Additionally, as shown, the pressure absorbing assembly 2510 can include a desk assembly 2518 that is substantially similar to the previous embodiments. However, in this embodiment, the pressure absorbing assembly 2510 is designed without a resting component.

Figure 26:
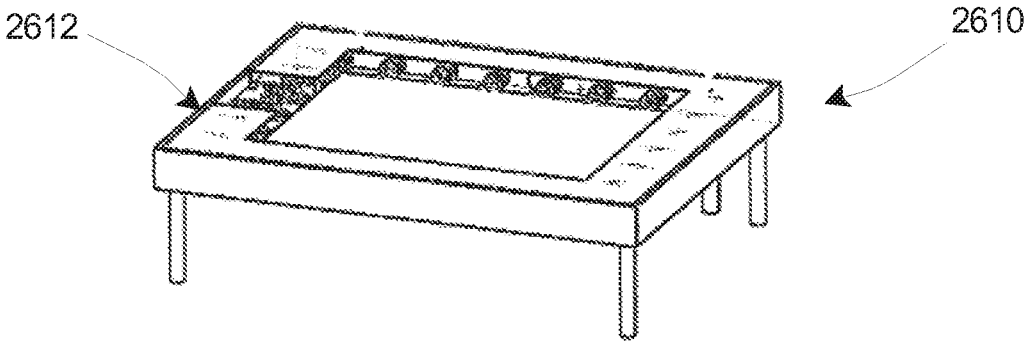
FIG. 26 is a simplified perspective view illustration of still yet another embodiment of the pressure absorbing assembly.

FIG. 26 is a simplified perspective view illustration of still yet another embodiment of the pressure absorbing assembly 2610. As shown, this embodiment of the pressure absorbing assembly 2610 is somewhat similar to the previous embodiments. For example, the pressure absorbing assembly 2610 again includes a pressure absorber 2612 that is substantially similar to the previous embodiments. However, in this embodiment, the pressure absorbing assembly 2610 is designed without a resting component or a desk assembly.

Figure 27B:
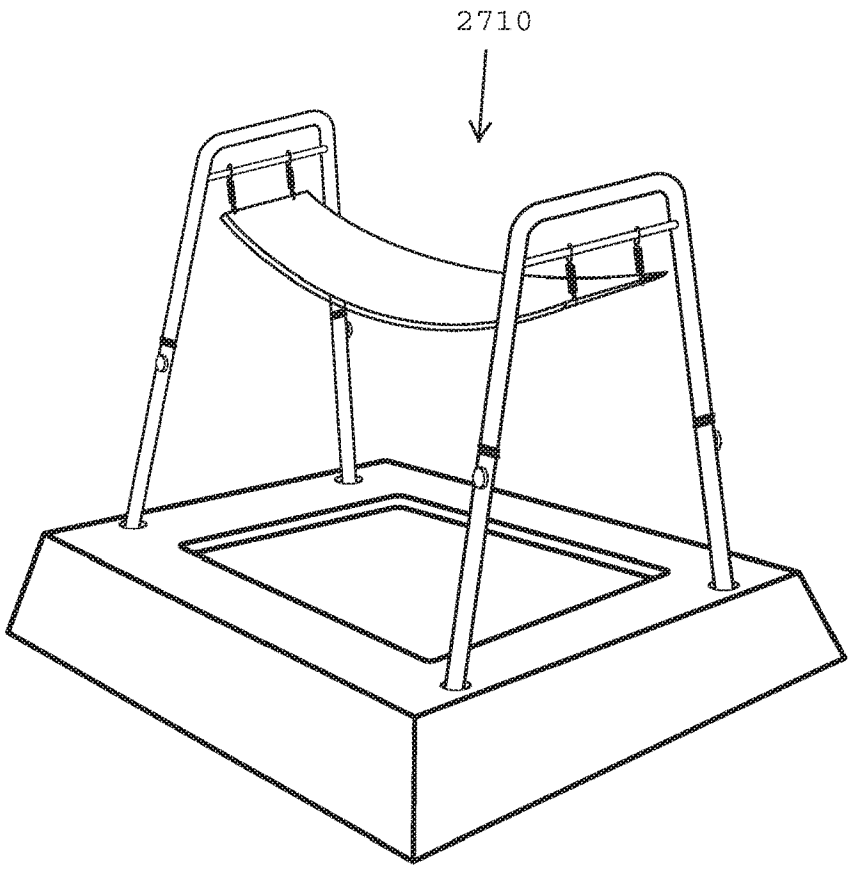
FIG. 27B is a simplified perspective view illustration of the pressure absorbing assembly illustrated in FIG. 27A.
Figure 27A:
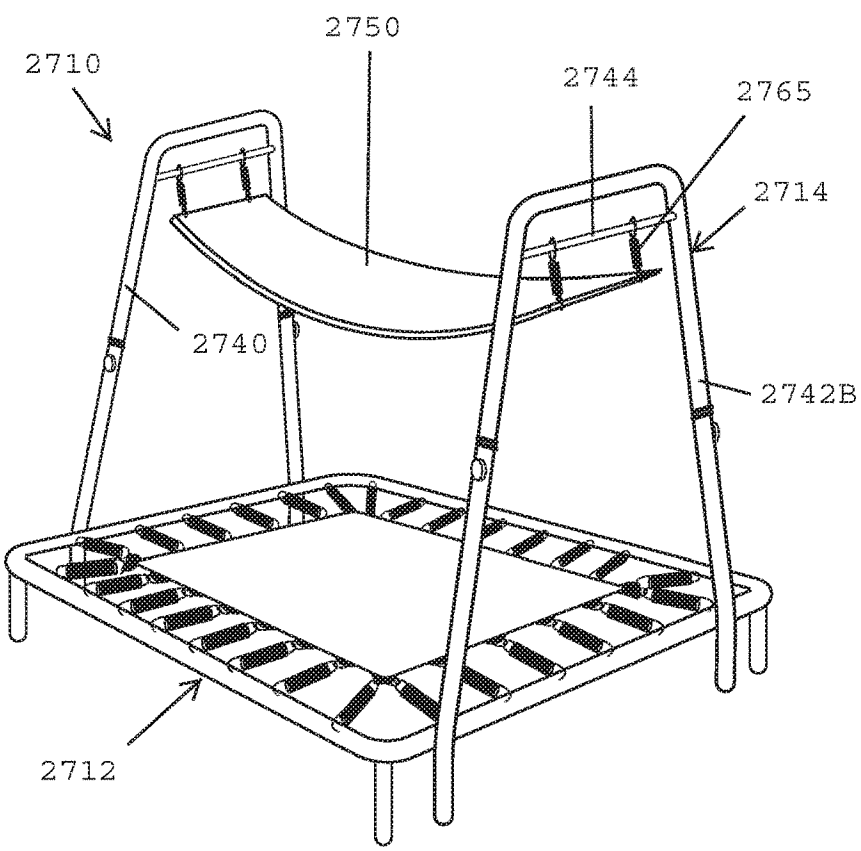
FIG. 27A is a simplified perspective view illustration of a portion of yet another embodiment of a pressure absorbing assembly having features of the present invention.

FIG. 27A is a simplified perspective view illustration of a portion of another embodiment of the pressure absorbing assembly 2710. As shown, this embodiment of the pressure absorbing assembly 2710 is somewhat similar to the previous embodiments described above. For example, the pressure absorbing assembly 2710 again includes a pressure absorber 2712 that is substantially similar to the previous embodiments.

As shown in FIG. 27A, the resting component 2714 is somewhat similar to the embodiment illustrated and described above in relation to FIG. 12A. As shown, the component holder 2744 in this embodiment is a straight bar that is coupled to and extends between portions of the upper support member 2742B of each side support component 2740.

However, in the embodiment illustrated in FIG. 27A, the resting component 2714 further includes a support seat 2750 (e.g., a flexible band, or rigid support with padding) that can be selectively positioned on the component holder 2744 of each side support component 2740 with support resilient members 2765 (e.g., springs or bungee cords). With this design, the support seat 2750 again provides a suitable place for the user 35 (illustrated in FIG. 1C) to rest on during use of the pressure absorbing assembly 2710. Further, the support seat 2750 can be pivoted away on the resilient members 2765 to allow the user 35 to stand on the pressure absorbing assembly 2710 and/or lean against the support seat 2750.

FIG. 27B is a simplified perspective view illustration of the pressure absorbing assembly 2710 illustrated in FIG. 27A.

As noted herein above, various embodiments of the pressure absorbing assembly can include and/or be utilized in conjunction with various types of work stations. For example, as illustrated in FIGS. 21-25, the pressure absorbing assembly can include and/or be used in conjunction with desk assembly, e.g., a stand-up desk assembly. Additionally, FIGS. 28-31 illustrate certain non-exclusive, alternative work stations that can be included as part of or can be used in conjunction with any embodiments of the pressure absorbing assembly illustrated and described herein.

Figure 28:
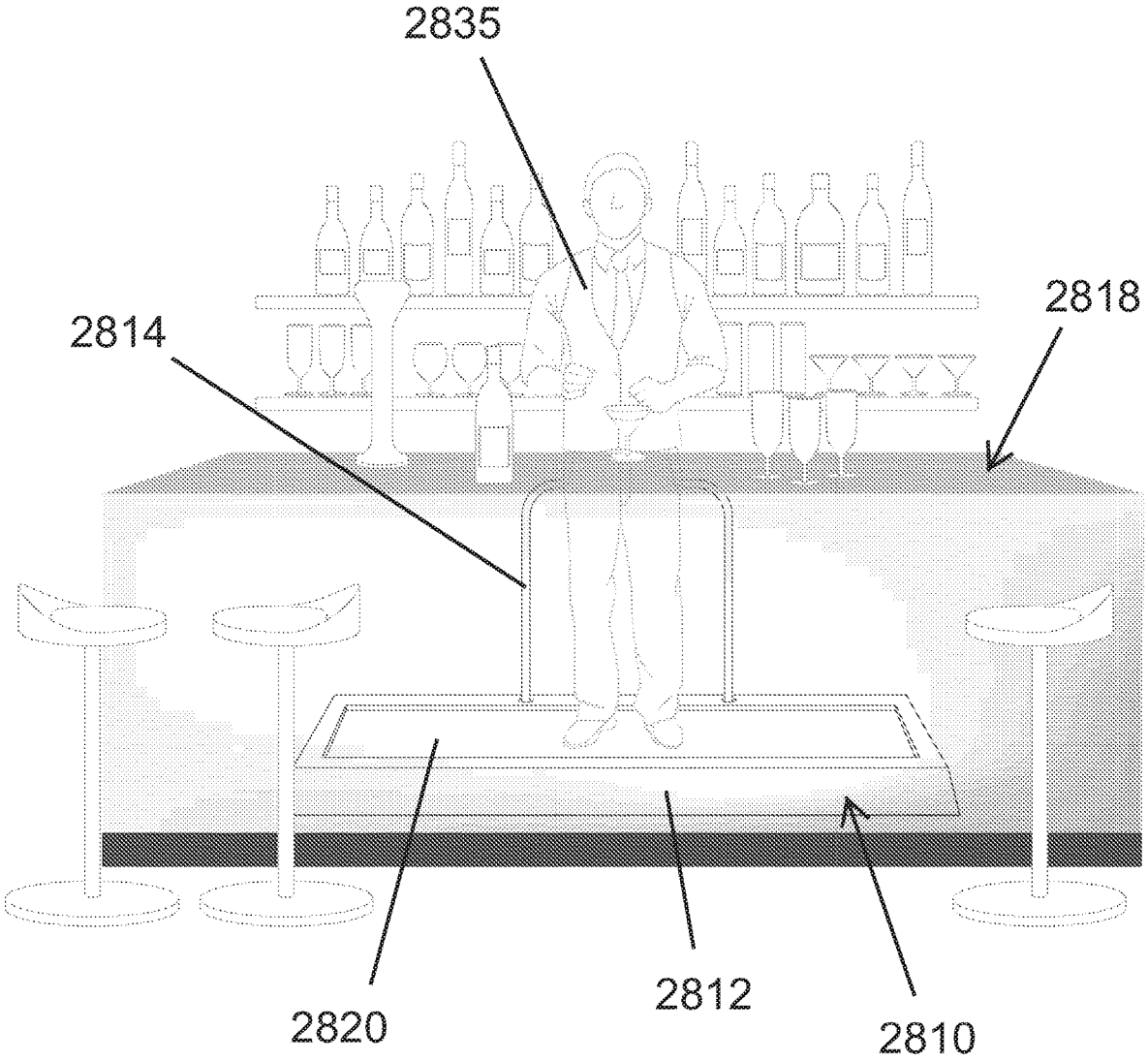
FIG. 28 is a simplified front view illustration of a bar, a bartender, and an embodiment of the pressure absorbing assembly being utilized by the bartender.

FIG. 28 is a simplified front view illustration of a work station 2818, i.e. a bar, a person 2835, i.e. a bartender, and an embodiment of the pressure absorbing assembly 2810 being utilized by the bartender 2835. As shown, this embodiment of the pressure absorbing assembly 2810 is somewhat similar to the previous embodiments. For example, the pressure absorbing assembly 2810 again includes a pressure absorber 2812 that is substantially similar to the previous embodiments, although the dimensions of the pressure absorber 2812 are somewhat different than in previous embodiments. More particularly, in this embodiment, the absorbing mat 2820 has a mat length that is greater than what was shown in previous embodiments, and the absorber frame (not shown in FIG. 28) has a length that is greater than what was shown in previous embodiments.

Additionally, FIG. 28 shows that the pressure absorbing assembly 2810 includes a resting component 2814 that can be similar to one or more of the resting components illustrated and described herein above.

However, as noted, this embodiment of the pressure absorbing assembly 2810 is configured to be used by a bartender 2835 who is working at a bar 2818. Thus, the pressure absorbing assembly 2810 is configured to support and decrease the fatigue of the bartender 2835, while not interfering with the movements of the bartender 2835 as the bartender 2835 is working at the bar 2818.

It is appreciated that although the pressure absorber 2812 and the resting component 2814 are not illustrated as being specifically coupled to the bar 2818; in certain alternative embodiments, one or both of the pressure absorber 2812 and the resting component 2814 can be coupled to the bar 2818.

Figure 29:
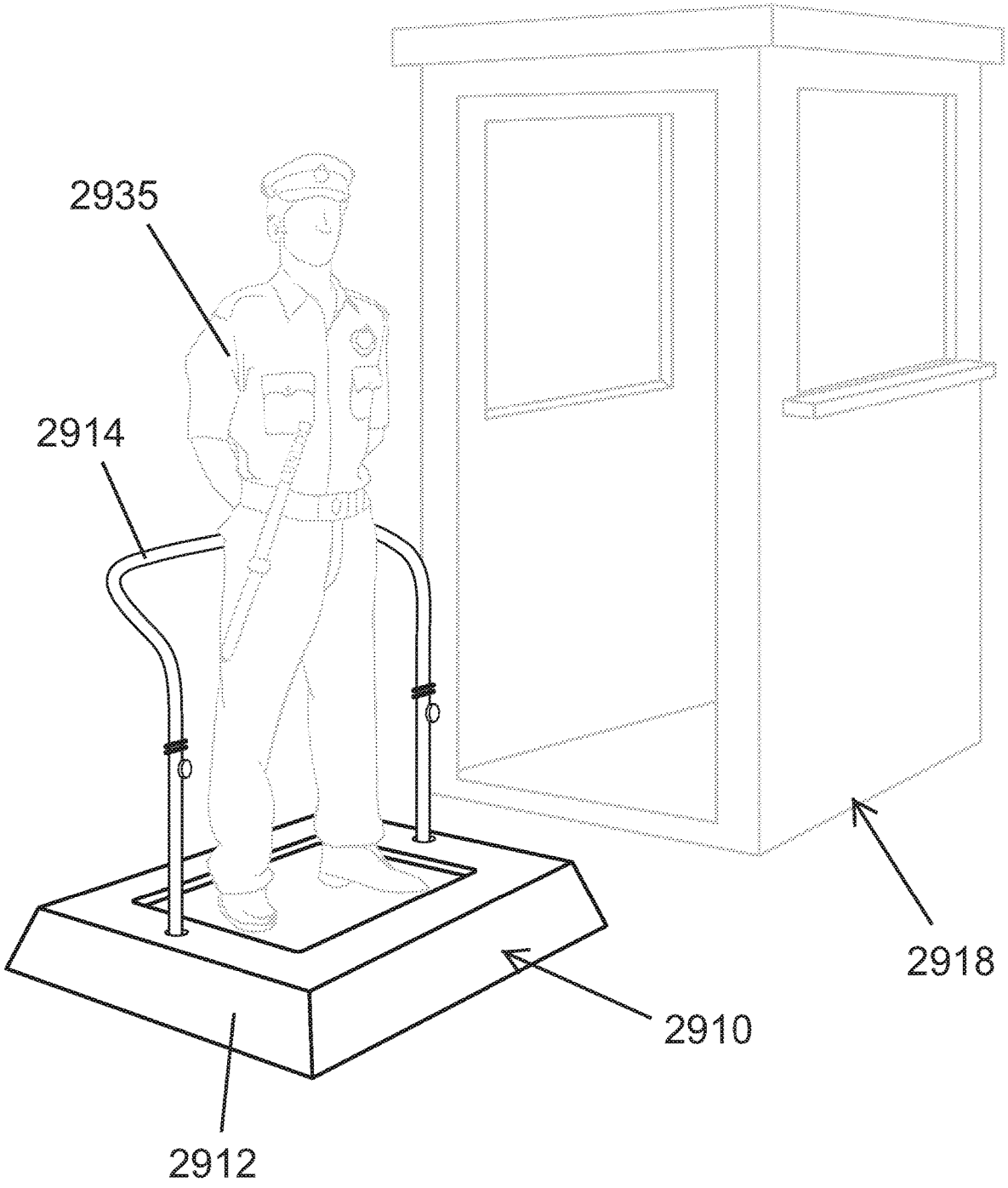
FIG. 29 is a simplified perspective view illustration of a guardhouse, a guard, and an embodiment of the pressure absorbing assembly being utilized by the guard.

FIG. 29 is a simplified perspective view illustration of a work station 2918, i.e. a guardhouse, a person 2935, i.e. a guard, and an embodiment of the pressure absorbing assembly 2910 being utilized by the guard 2935. As shown, this embodiment of the pressure absorbing assembly 2910 is somewhat similar to the previous embodiments. For example, the pressure absorbing assembly 2910 again includes a pressure absorber 2912 that is substantially similar to the previous embodiments.

Additionally, FIG. 29 shows that the pressure absorbing assembly 2910 includes a resting component 2914 that can be similar to one or more of the resting components illustrated and described herein above.

However, as noted, this embodiment of the pressure absorbing assembly 2910 is configured to be used by a guard 2935 who is working at a guardhouse 2918. Thus, the pressure absorbing assembly 2910 is configured to support and decrease the fatigue of the guard 2935, while not interfering with the movements of the guard 2935 as the guard 2935 is working at the guardhouse 2918.

Figure 30:
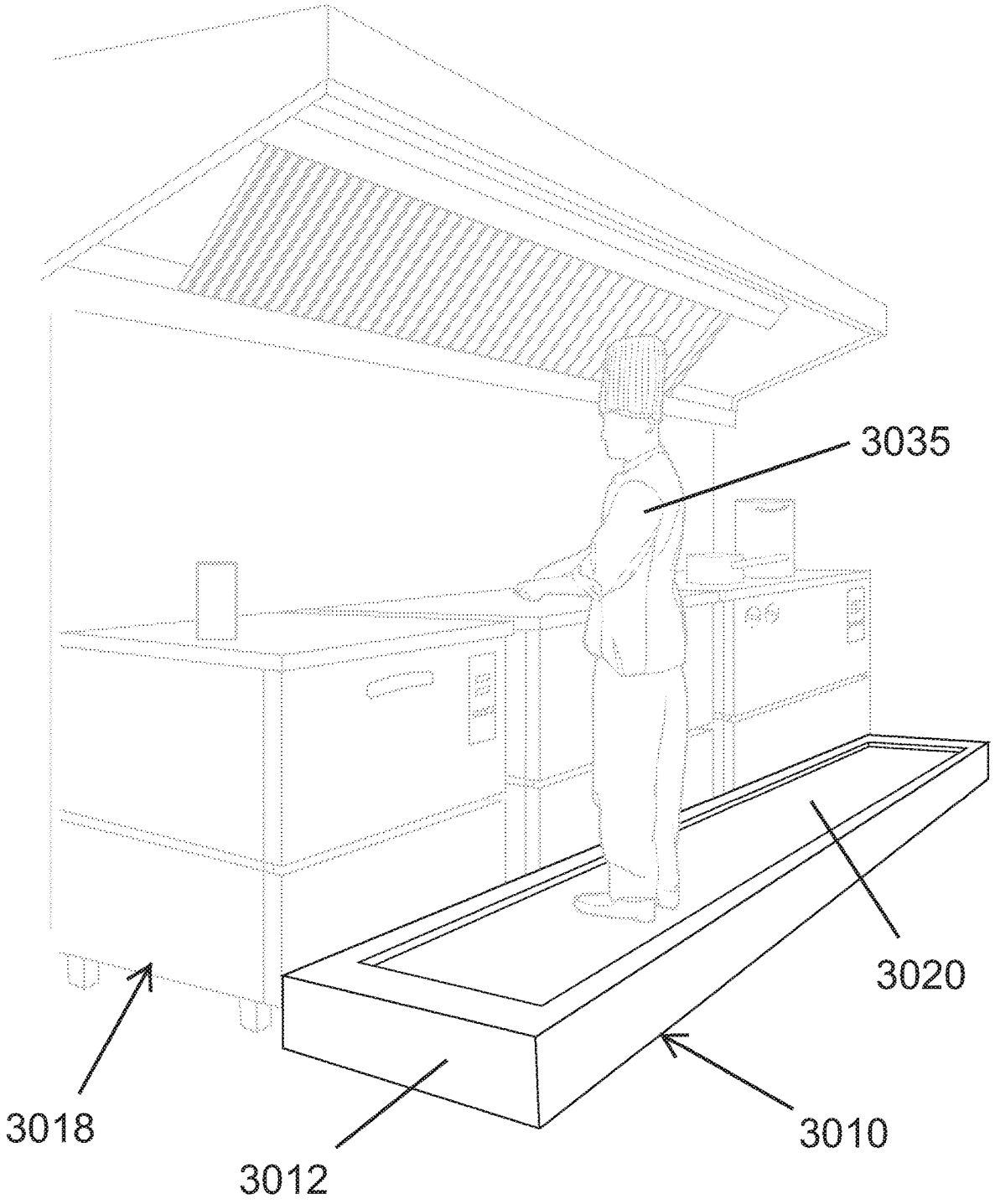
FIG. 30 is a simplified perspective view illustration of a kitchen, a chef, and an embodiment of the pressure absorbing assembly being utilized by the chef.

FIG. 30 is a simplified perspective view illustration of a work station 3018, i.e. a kitchen work station with a countertop, a stovetop and an oven, a person 3035, i.e. a chef, and an embodiment of the pressure absorbing assembly 3010 being utilized by the chef 3035. As shown, this embodiment of the pressure absorbing assembly 3010 is somewhat similar to the previous embodiments. For example, the pressure absorbing assembly 3010 again includes a pressure absorber 3012 that is substantially similar to the previous embodiments, although the dimensions of the pressure absorber

3012 are somewhat different than in previous embodiments. More particularly, in this embodiment, the absorbing mat 3020 has a mat length that is greater than what was shown in previous embodiments, and the absorber frame (not shown in FIG. 30) has a length that is greater than what was shown in previous embodiments.

However, in the embodiment illustrated in FIG. 30, the pressure absorbing assembly 3010 does not include a resting component.

Additionally, as noted, this embodiment of the pressure absorbing assembly 3010 is configured to be used by a chef 3035 who is working at a kitchen work station 3018. Thus, the pressure absorbing assembly 3010 is configured to support and decrease the fatigue of the chef 3035, while not interfering with the movements of the chef 3035 as the chef 3035 is working at the kitchen work station 3018.

It is appreciated that although the pressure absorber 3012 is not illustrated as being specifically coupled to the kitchen work station 3018; in certain alternative embodiments, the pressure absorber 3012 can be coupled to the kitchen work station 3018.

Figure 31:
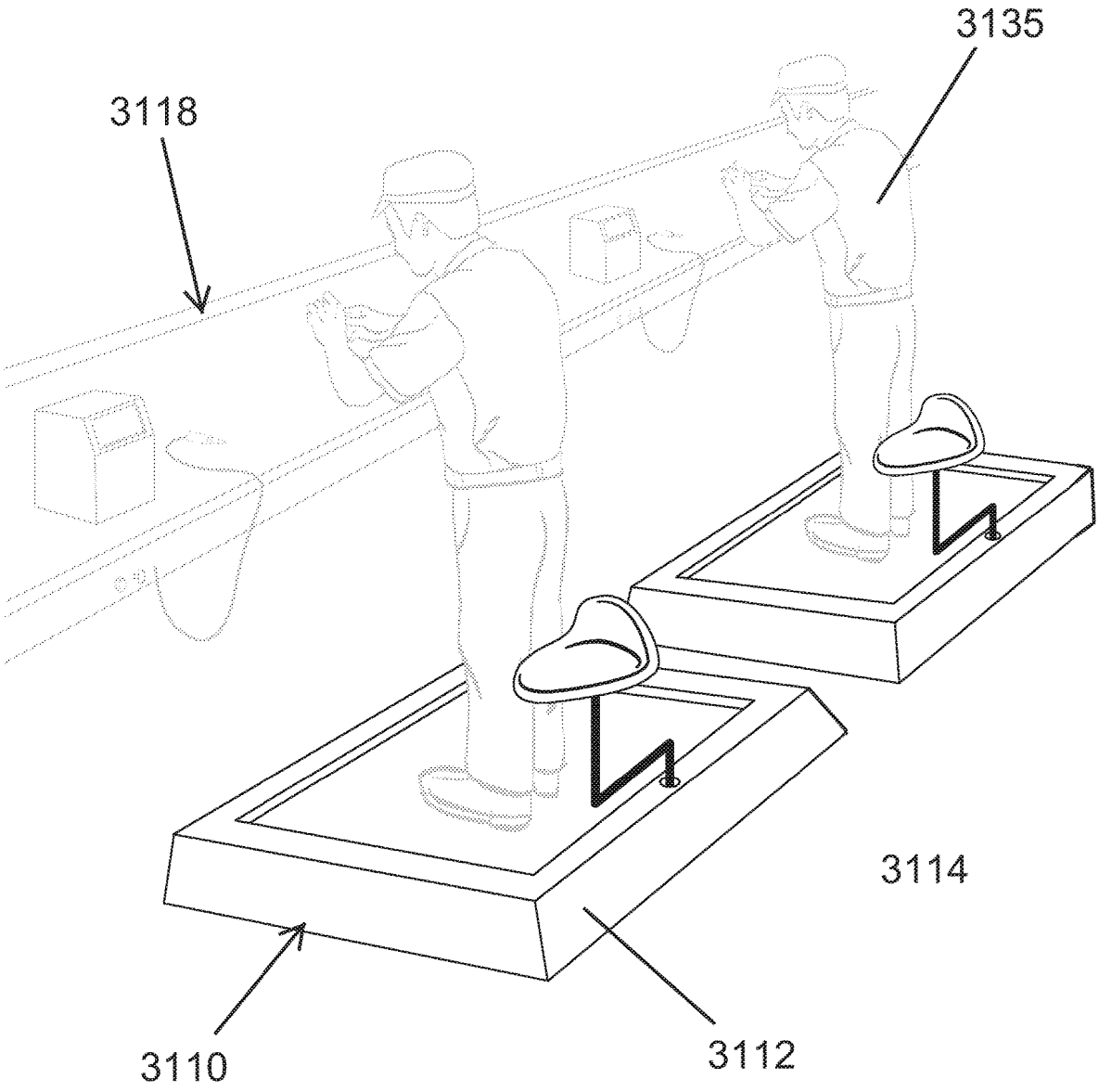
FIG. 31 is a simplified perspective view illustration of a factory assembly line, a pair of assembly line workers, and embodiments of the pressure absorbing assembly being utilized by the pair of assembly line workers.

FIG. 31 is a simplified perspective view illustration of a work station 3118, i.e. a factory assembly line, two people 3135, i.e. a pair of assembly line workers, and embodiments of the pressure absorbing assembly 3110 being utilized by the pair of assembly line workers 3135. As shown, this embodiment of the pressure absorbing assembly 3110 is somewhat similar to the previous embodiments. For example, the pressure absorbing assembly 3110 again includes a pressure absorber 3112 that is substantially similar to the previous embodiments.

Additionally, FIG. 31 shows that the pressure absorbing assembly 3110 includes a resting component 3114 that can be similar to one or more of the resting components illustrated and described herein above.

However, as noted, this embodiment of the pressure absorbing assembly 3110 is configured to be used by assembly line workers 3135 who is working at a factory assembly line 3118. Thus, the pressure absorbing assembly 3110 is configured to support and decrease the fatigue of the assembly line workers 3135, while not interfering with the movements of the assembly line workers 3135 as the assembly line workers 3135 are working at the factory assembly line 3118.

It is appreciated that although the pressure absorber 3112 and the resting component 3114 are not illustrated as being specifically coupled to the factory assembly line 3118; in certain alternative embodiments, one or both of the pressure absorber 3112 and the resting component 3114 can be coupled to the factory assembly line 3118.

It is understood that although a number of different embodiments of the pressure absorbing assembly 10 have been illustrated and described herein, one or more features of any one embodiment can be combined with one or more features of one or more of the other embodiments, provided that such combination satisfies the intent of the present invention.

While a number of exemplary aspects and embodiments of a pressure absorbing assembly 10 have been shown and disclosed herein above, those of skill in the art will recognize certain modifications, permutations, additions and subcombinations thereof. It is therefore intended that the pressure absorbing assembly 10 shall be interpreted to include all such modifications, permutations, additions and subcombinations as are within their true spirit and scope, and no limitations are intended to the details of construction or design herein shown.

What is claimed is:

1. A pressure absorbing assembly for supporting a user relative to a support surface, the pressure absorbing assembly comprising:

a pressure absorber that is configured to contact the support surface, the pressure absorber being configured to resiliently support the user relative to the support surface, the pressure absorber including (i) a pressure absorbing mat, (ii) an absorber frame, (iii) at least one resilient member that resiliently couples the pressure absorbing mat to the absorber frame to maintain the pressure absorbing mat in tension, and (iv) at least one leg that is coupled to the absorber frame and supports the absorber frame above and away from the support surface such that the pressure absorbing mat is positioned less than approximately thirty centimeters above the support surface when the pressure absorbing mat is in an undeflected configuration; and a resting component that is coupled to the pressure absorber, the resting component being configured to be selectively engaged by the user during use of the pressure absorber, the resting component including a seat support that is coupled to the pressure absorber, and a seat that is coupled to and supported by the seat support, the seat being configured to be selectively adjustable relative to the pressure absorber between a first position where the seat extends at least partially over the pressure absorbing mat and a second position where the seat does not extend over the pressure absorbing mat.

2. The pressure absorbing assembly of claim 1 wherein the resting component is directly coupled to the pressure absorber.

3. The pressure absorbing assembly of claim 1 wherein the pressure absorber includes a plurality of resilient members that resiliently couple the pressure absorbing mat to the absorber frame to maintain the pressure absorbing mat in tension; and wherein the plurality of resilient members are configured to have a high enough tension on the pressure absorbing mat so that the pressure absorbing mat deflects less than thirteen centimeters when being used by the user.

4. The pressure absorbing assembly of claim 3 wherein the pressure absorber is configured to support up to four hundred pounds at one time without the pressure absorbing mat deflecting greater than thirteen centimeters.

5. The pressure absorbing assembly of claim 1 wherein the pressure absorbing mat is positioned between approximately ten centimeters and fifteen centimeters above the support surface when the pressure absorbing mat is in the undeflected configuration.

6. The pressure absorbing assembly of claim 1 wherein the resting component is fixedly coupled to the pressure absorber.

7. The pressure absorbing assembly of claim 1 wherein the resting component is removably coupled to the pressure absorber.

8. The pressure absorbing assembly of claim 1 wherein the seat is coupled to the seat support when the seat is in each of the first position and the second position.

9. The pressure absorbing assembly of claim 1 wherein the seat support is coupled to the absorber frame.

10. The pressure absorbing assembly of claim 1 wherein the seat support includes a lower support member and an upper support member that is adjustably coupled to the lower support member to selectively adjust a height of the seat relative to the pressure absorber.

11. The pressure absorbing assembly of claim 1 wherein the seat is selectively rotatable relative to the seat support between the first position and the second position.

12. The pressure absorbing assembly of claim 1 further comprising a work station that is coupled to the pressure absorber.

13. The pressure absorbing assembly of claim 12 wherein the work station is directly coupled to the pressure absorber.

14. The pressure absorbing assembly of claim 1 wherein the pressure absorbing mat has a surface area of less than 7125 square centimeters.

15. A pressure absorbing assembly for supporting a user relative to a support surface, the pressure absorbing assembly comprising:

a pressure absorber that is configured to contact the support surface, the pressure absorber being configured to resiliently support the user relative to the support surface, the pressure absorber including (i) a pressure absorbing mat, (ii) an absorber frame, (iii) at least one resilient member that resiliently couples the pressure absorbing mat to the absorber frame to maintain the pressure absorbing mat in tension, and (iv) at least one leg that is coupled to the absorber frame and supports the absorber frame above and away from the support surface such that the pressure absorbing mat is positioned less than approximately thirty centimeters above the support surface when the pressure absorbing mat is in an undeflected configuration; and a resting component that is coupled to the pressure absorber, the resting component being configured to be selectively engaged by the user during use of the pressure absorber, the resting component including a seat support that is coupled to the pressure absorber, and a seat that is coupled to and supported by the seat support, the seat being configured to be selectively adjustable between a first position and a second position relative to the pressure absorbing mat; wherein in the first position, the seat extends at least partially over the pressure absorbing mat.

16. The pressure absorbing assembly of claim 15 wherein the pressure absorber includes a plurality of resilient members that resiliently couple the pressure absorbing mat to the absorber frame to maintain the pressure absorbing mat in tension; and wherein the plurality of resilient members are configured to have a high enough tension on the pressure absorbing mat so that the pressure absorbing mat deflects less than thirteen centimeters when being used by the user.

17. The pressure absorbing assembly of claim 16 wherein the pressure absorber is configured to support up to four hundred pounds at one time without the pressure absorbing mat deflecting greater than thirteen centimeters.

18. The pressure absorbing assembly of claim 15 further comprising a work station that is coupled to the pressure absorber, the work station being configured to provide a working area for the user of the pressure absorbing assembly.

19. The pressure absorbing assembly of claim 18 wherein the work station is directly coupled to the pressure absorber.

20. The pressure absorbing assembly of claim 15 wherein the pressure absorbing mat has a surface area of less than 7125 square centimeters.

* * * * *